United States Patent [19]

Weimer et al.

[11] 4,192,551

[45] Mar. 11, 1980

[54] REMOTE CONTROL SYSTEM FOR MINING MACHINES

[75] Inventors: James C. Weimer; William S. Locks, both of Bethlehem; Edwin B. Wilson, Quakertown; Francis G. Miller, Bethlehem, all of Pa.

[73] Assignee: Bethlehem Steel Corporation, Bethlehem, Pa.

[21] Appl. No.: 949,911

[22] Filed: Oct. 10, 1978

[51] Int. Cl.[2] ..... E21C 35/24

[52] U.S. Cl. ..... 299/1; 91/459; 299/30

[58] Field of Search ..... 299/1, 30; 91/459

[56] References Cited

U.S. PATENT DOCUMENTS

| | | | |
|---|---|---|---|
| 3,335,881 | 8/1967 | Pahlsjo | 91/459 X |
| 3,400,768 | 9/1968 | Kuipers et al. | 173/1 |
| 3,460,868 | 8/1969 | Luksich | 299/71 |
| 3,762,076 | 10/1973 | Eftefield | 91/459 X |
| 3,776,592 | 10/1973 | Ewing | 299/1 |
| 3,874,407 | 1/1974 | Griswold | 91/459 X |
| 4,011,891 | 8/1975 | Knutson et al. | 91/382 X |
| 4,072,087 | 2/1978 | Mueller | 91/459 X |

OTHER PUBLICATIONS

Cable & Wireless Remote Control of Continuous Miners, Mining Congress Journal, Oct., 1974, pp. 34–39.

Remote Control for Continuous Miner, Coal Age, Aug. 1958, pp. 98–101.

Remote Control Mining & Cont. Roof Bolting, Mining Congress Journal, Sep. 1976.

*Primary Examiner*—Ernest R. Purser

*Attorney, Agent, or Firm*—Joseph J. O'Keefe; Michael J. Delaney; George G. Dower

[57] ABSTRACT

An intrinsically safe system controls all miner hydraulic and electrical functions from a hand held miner remote control pendant. Pendant control devices provide on/-off control signals to interfaces with miner drive and pump controllers, as well as a group of ±6 VDC differential proportional and on/off control signals to respective electronic valve drivers. Valve driver outputs are fed to respective force motors on pilot stage valves which control each hydraulic function. Each valve driver output is modified by offset and dither signals to overcome power stage valve dead band and frictional characteristics. Pilot stage valves have an internal feedback sleeve coacting with a pilot valve spool in a hydraulic servo circuit. Pilot stage valves operate in a pilot oil system which may be isolated from power oil systems.

27 Claims, 16 Drawing Figures

FIG 5
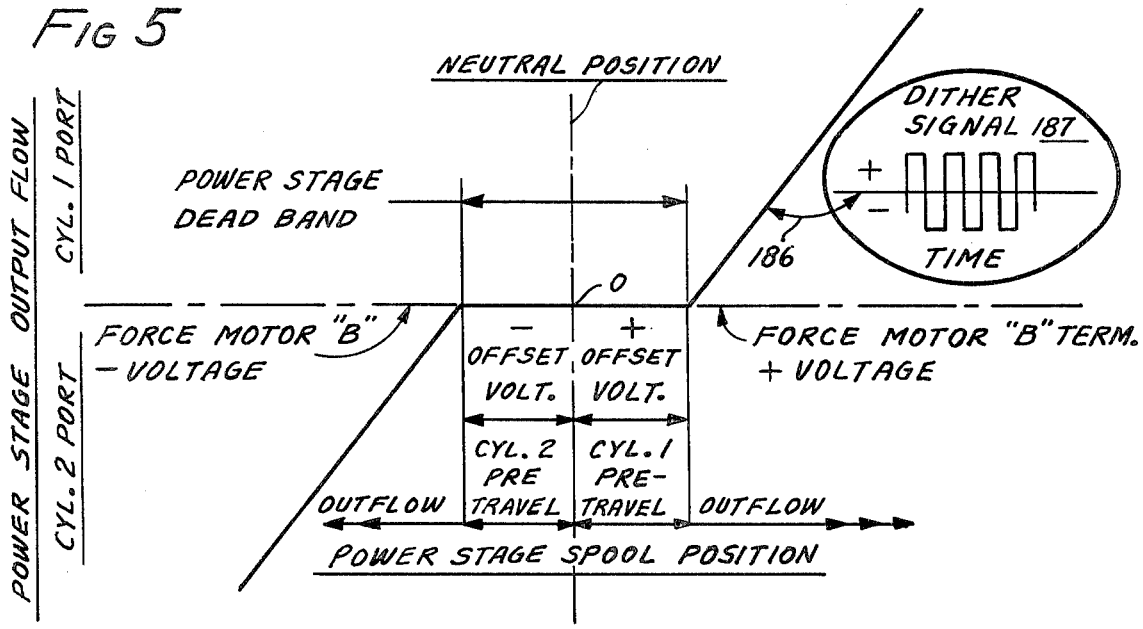
FIG. 6
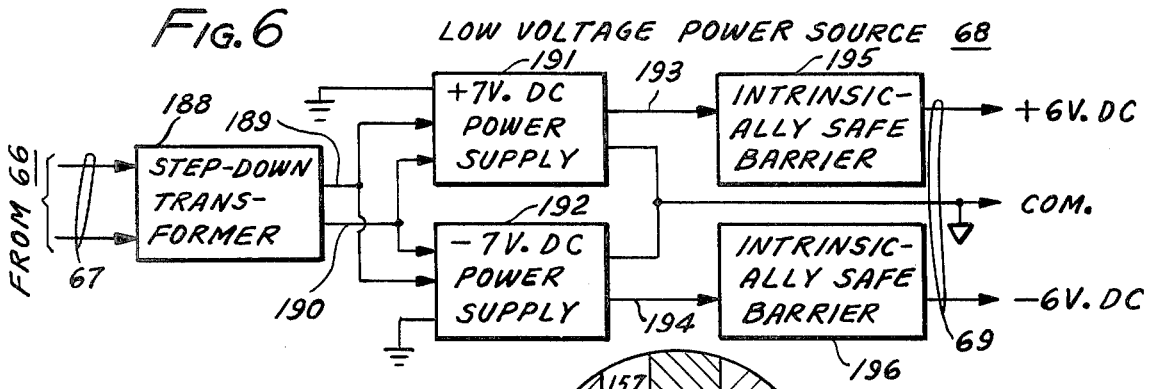
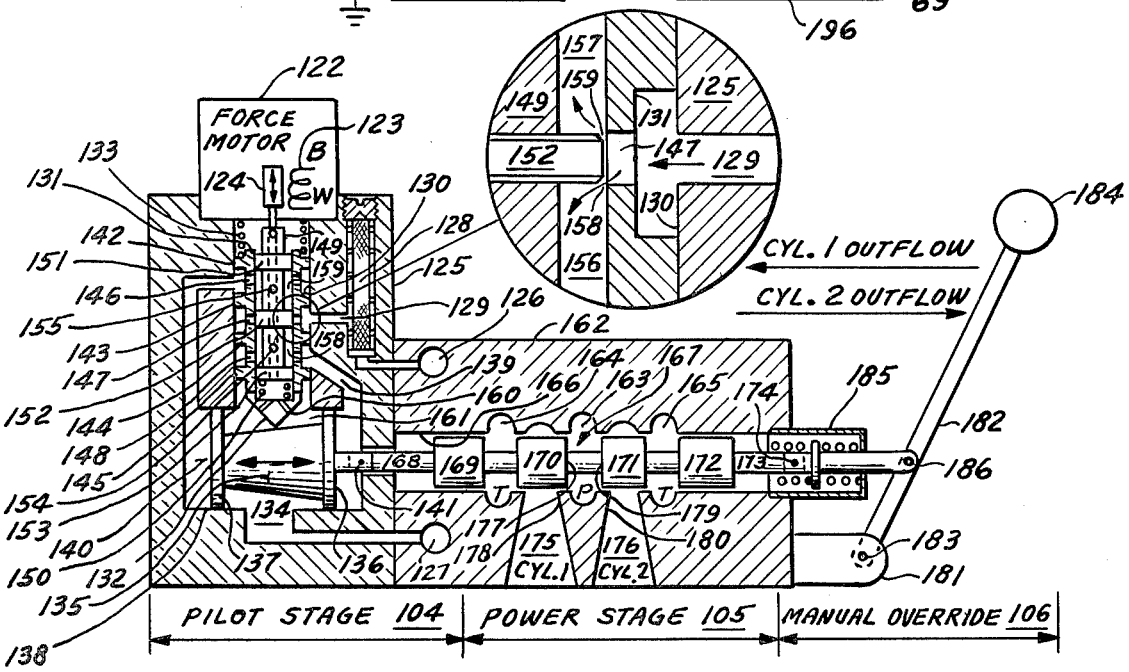
FIG. 4

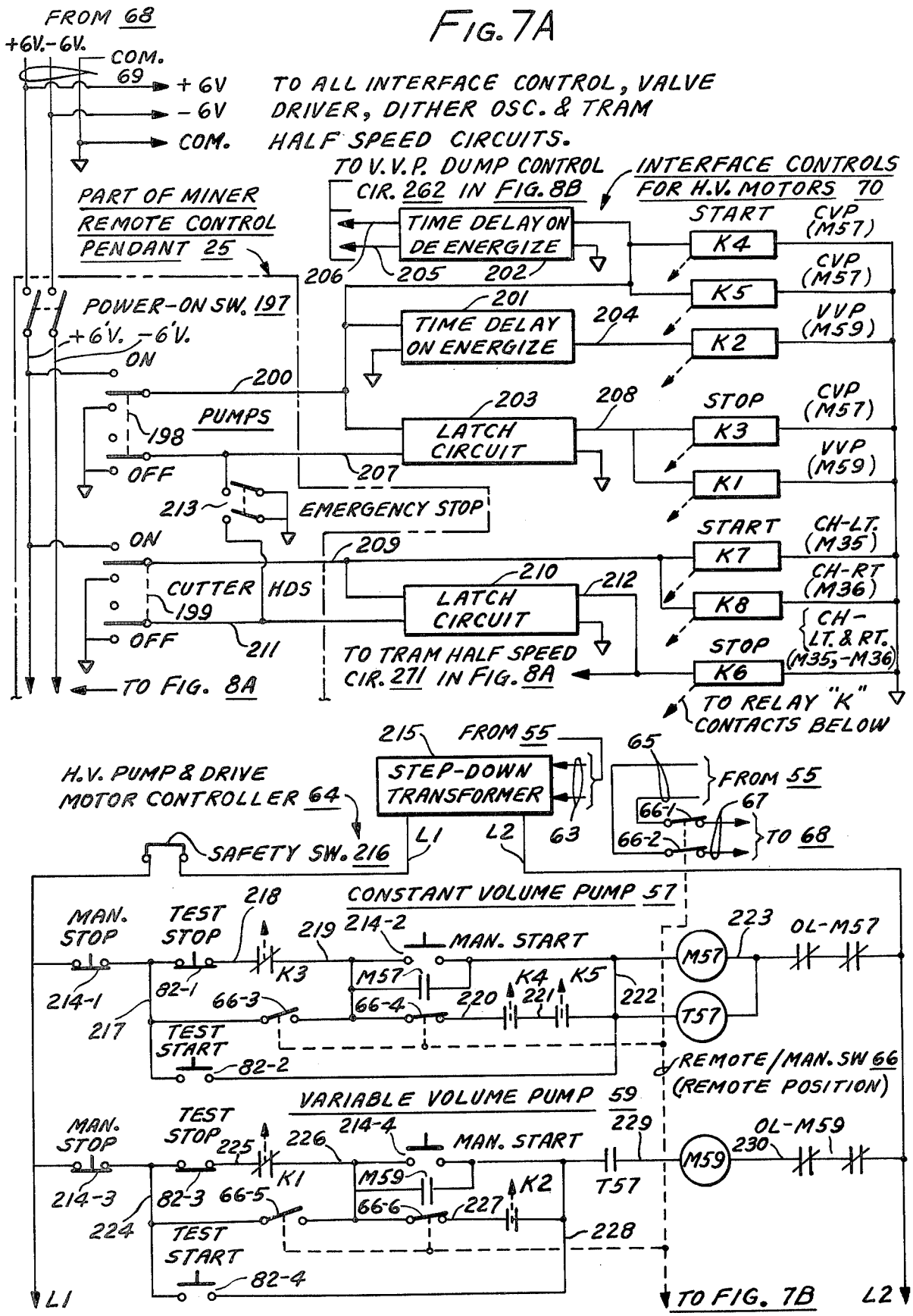
FIG. 7A
FROM 68
+6V.-6V.
COM.
69
+6V
-6V
COM.
TO ALL INTERFACE CONTROL, VALVE DRIVER, DITHER OSC. & TRAM HALF SPEED CIRCUITS.
TO V.V.P. DUMP CONTROL CIR. 262 IN FIG. 8B
INTERFACE CONTROLS FOR H.V. MOTORS 70
PART OF MINER REMOTE CONTROL PENDANT 25
TIME DELAY ON DE ENERGIZE
TIME DELAY ON ENERGIZE
LATCH CIRCUIT
LATCH CIRCUIT
POWER-ON SW. 197
+6V. -6V.
ON
OFF
PUMPS
198
200
201
202
203
204
205
206
207
208
209
210
211
212
213
EMERGENCY STOP
CUTTER
HDS
199
START
STOP
K4
K5
K2
K3
K1
K7
K8
K6
CVP (M57)
VVP (M59)
CH-LT. (M35)
CH-RT (M36)
CH-LT. & RT. (M35,-M36)
TO FIG. 8A
TO TRAM HALF SPEED CIR. 271 IN FIG. 8A
TO RELAY "K" CONTACTS BELOW
215
FROM 55
STEP-DOWN TRANSFORMER
H.V. PUMP & DRIVE MOTOR CONTROLLER 64
SAFETY SW. 216
L1
L2
63
65
66-1
66-2
67
TO 68
CONSTANT VOLUME PUMP 57
MAN. STOP
TEST STOP
MAN. START
TEST START
214-1
214-2
217
218
219
220
221
222
223
82-1
82-2
66-3
66-4
K3
K4
K5
M57
T57
OL-M57
REMOTE/MAN. SW 66 (REMOTE POSITION)
VARIABLE VOLUME PUMP 59
214-3
214-4
224
225
226
227
228
229
230
82-3
82-4
66-5
66-6
K1
K2
M59
OL-M59
TO FIG. 7B
L1
L2

FIG. 9
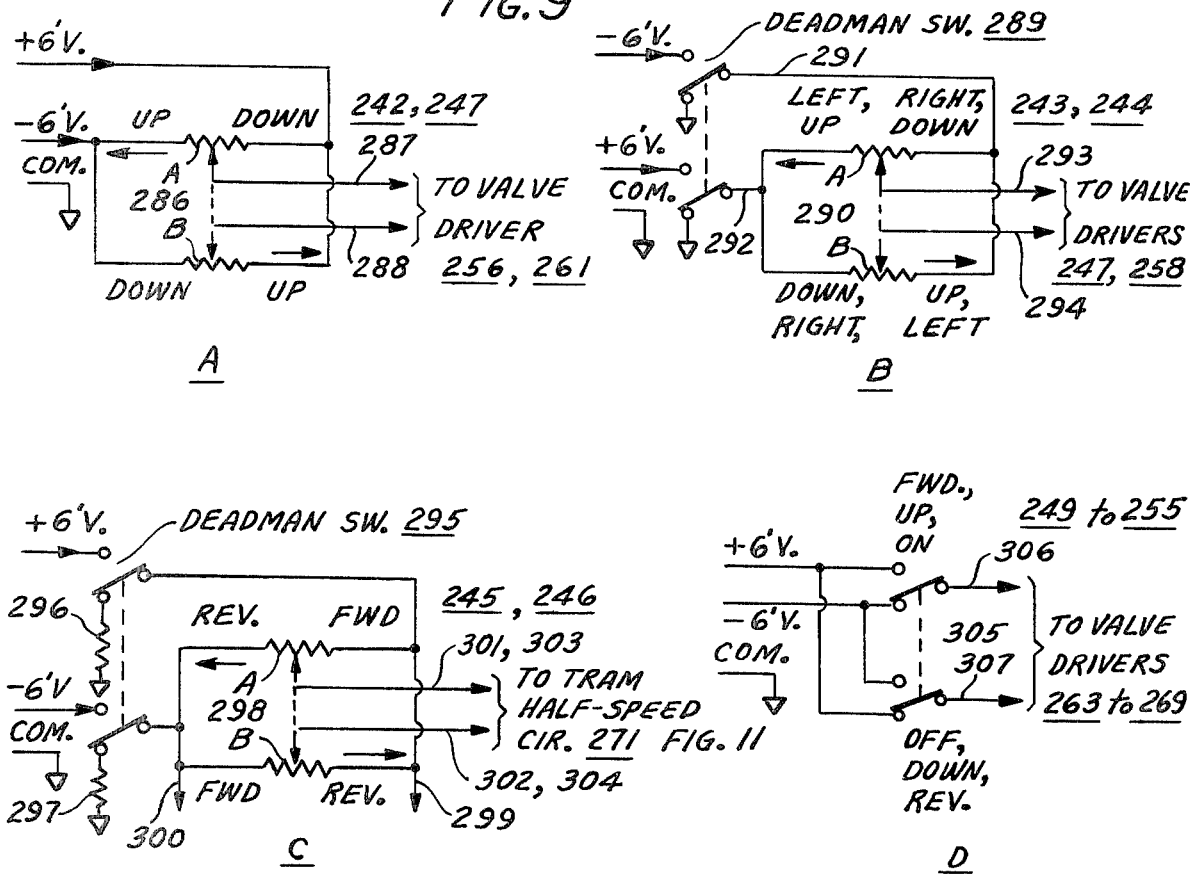
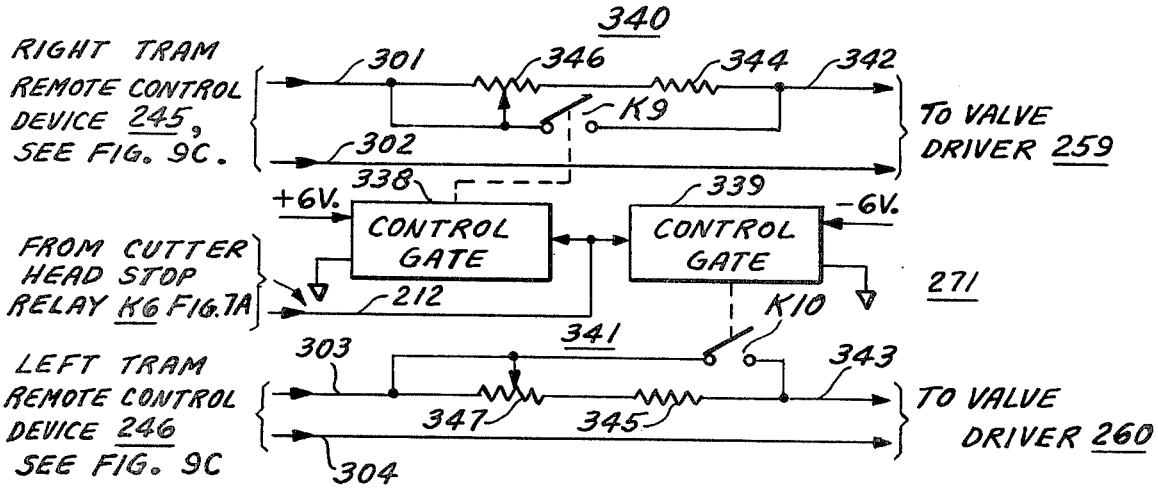
FIG. 11

REMOTE CONTROL SYSTEM FOR MINING MACHINES

BACKGROUND OF THE INVENTION

1. Field of the Invention

This invention relates broadly to underground mining machines, and more particularly to remote control systems for underground mining machines. The invention may be used in an underground continuous miner as described herein, or used in other mining machines such as conveyor-bolters and the like.

In underground coal mining facilities, for example, there has been a long need to increase coal production, mining efficiency and operating safety procedures. One way to increase coal production and mining efficiency with continuous miners in both new and existing coal mines is to permit the continuous miner to take deeper cuts before moving to a new mining site. This practice, however, subjects the human operator of conventional continuous miners and conveyor-bolters to undue hazards rather than increasing operating safety procedures.

It has been suggested that one way to achieve increased coal production, mining efficiency and operating safety is to make the deeper cuts with continuous miners and/or conveyor-bolters operating under control of a remote control system. However, those mining machine manufacturers that may build mining machines with a remote control system do so to provide a service-reliable package that will withstand the severest electrical hazard and other mining environmental conditions, but at the expense of operating flexibility.

For example, one prior art remote control system may include basic features of an on/off control in the electrical and solenoid controlled hydraulic systems. Another may offer complex stepwise control of certain functions, but this is not a true proportional control system. Such basic and stepwise control systems are listed by the U.S. Dept. of Labor, Mine Safety and Health Administration (MSHA), as "permissible". That is, electrical and/or control systems which operate at energy levels sufficient to ignite a methane and air mixture are permitted in mines if contained in heavy metallic explosion-proof enclosures and/or other means to safely handle electrical hazards sometimes present in mines in the form of an explosive mixture of methane gas and air.

Other deficiencies in the prior art mining machine remote control system, in addition to that of lacking true proportional control features, include the absence of MSHA listed "intrinsically safe" electro-control valves and controllers for both proportional and on/off fluid control functions. That is, electrical control systems which operate at low energy levels are considered "intrinsically safe" and permitted in mines in nonexplosion-proof enclosures if the electrical energy released by the control circuit is not sufficient to ignite an explosive mixture of methane and air. This classification is in contrast to MSHA "permissible" defined above and if attainable permits much simpler control housing and wiring requirements, in addition to reducing maintenance programs and personnel requirements as compared to "permissible" systems.

Additional deficiencies in the prior art mining machine remote control systems are attributable to their lack of applicability to all coal mining machines; their inability to be retrofitted into existing mining machines; their lack of offering a light-weight control console; their susceptibility to control valve contamination and subsequent malfunction; and/or their inability to be easily repaired underground.

SUMMARY OF THE INVENTION

A main object of the present invention is to provide an improved remote control system for mining machines which will overcome the aforesaid deficiencies in the prior art.

Another object of this invention is to provide an improved remote control system for mining machines which results in increased production, mining efficiency, operating safety and reliability.

The foregoing objects may be achieved by an intrinsically safe, universal, mine-worthy remote control system for mining machines having both electrical and hydraulic systems wherein there is included banks of proportional and on/off electro-control valves, each having an intrinsically safe pilot stage force motor, an intrinsically safe low voltage power supply, a hand-held remote control pendant cabled to trail the mining machine and provided with proportional and on/off control devices which generate low voltage signals for controlling all electrical and hydraulic functions on the mining machine including half-tram speed, a group of differential electronic electro-control valve drivers each receiving a different proportional or on/off control signal from the pendant for energizing differentially a respective force motor, each valve driver differential output signal being modified by offset and dither components to overcome valve dead band and friction, also solid-state machine interface circuitry for using low voltage control devices to control high voltage machine pump and cutter drive functions, and remote/manual and interface test switches.

The present remote control system is made intrinsically safe in an explosion-proof enclosure by transforming 460 VAC high voltage to a lower voltage which energizes solid-state rectifiers that produce ±7 VDC low voltage sources which are passed through respective protective barrier networks, thereby establishing a low voltage power source having ±6 VDC outputs. Also housed in another explosion-proof enclosure are high voltage pump and drive motor controllers and the machine interface circuitry. The low voltage valve drivers and related circuitry, each pilot valve force motor, the remote/manual switch and test switches are housed in respective nonexplosion-proof housings, thereby simplifying the remote control system design, cost, installation and maintenance requirements.

Universality of the present remote control system is achieved in part by open-center closed-center, manual-override, electo-control valves driven by a respective force motor in both proportional control and on/off electrocontrol valve banks, each valve being a direct substitute for existing manual valves on many types of mining machines. In addition, the remote control pendant is provided with control devices having one low voltage output and all valve drivers are of one design and constructed on plug-in circuit boards for interchangeability within their enclosure. Those universal features make the present remote control system capable of being retrofitted into existing manually controlled mining machines.

The present remote control system is made mine-worthy in part by special hydraulic features related to resistance to heat, dirt and vibration in electro-control valves wherein pilot stages are fed from a filtered and cooled pilot stage oil source completely isolated from a power stage oil source which feeds power stages coupled to pilot stages in electro-proportional control valves. In addition, each pilot stage is provided with an intrinsically safe force motor coupled to a pilot spool which operates with a mechanical feedback sleeve in a hydraulic servo circuit with the pilot stage piston. Thus, when the force motor is energized with the valve driver differential signal modified with offset and dither components, the pilot stage hydraulic servo circuit, as well as the power stage circuit, is considerably less susceptible to undesirable effects of dirt and vibration. In addition to these features and valve interchangeability, the intrinsically safe level of remote control pendant signals, valve drivers, force motors and motor interface circuitry make it possible to repair and maintain the present remote control system in a hazardous atmosphere underground in a mine site. This is highly advantageous because of the lost productivity, and increased expense of repairing underground mining machines above ground as is the case of prior art apparatus such as the "permissible" mining machines noted above.

BRIEF DESCRIPTION OF THE DRAWINGS

FIG. 4 is a schematic cross-sectional view of an electro-hydraulic control valve having a force motor driven pilot stage, a power stage and a manual override feature as used in the present invention.

FIG. 5 is a graph representing the FIG. 4 valve power stage output flow vs. power stage spool position and force motor voltage requirements, and illustrates offset or pretravel and dither signals required to overcome power stage valve deadband, frictional characteristics and contaminant effects.

FIG. 6 is a block diagram of an intrinsically safe low voltage power source used in the present invention.

FIGS. 7A and 7B are electrical schematic diagrams showing a portion of the miner remote control pendant, interface controls and high voltage (H.V.) pump and cutter head drive controls.

FIGS. 9A–9D are electrical schematic diagrams of various proportional and on/off control devices used in the miner remote control pendant of the present invention.

FIG. 11 is an electrical schematic diagram of a tram half-speed circuit used in the present invention.

DESCRIPTION OF THE PREFERRED EMBODIMENT

Figure 1:
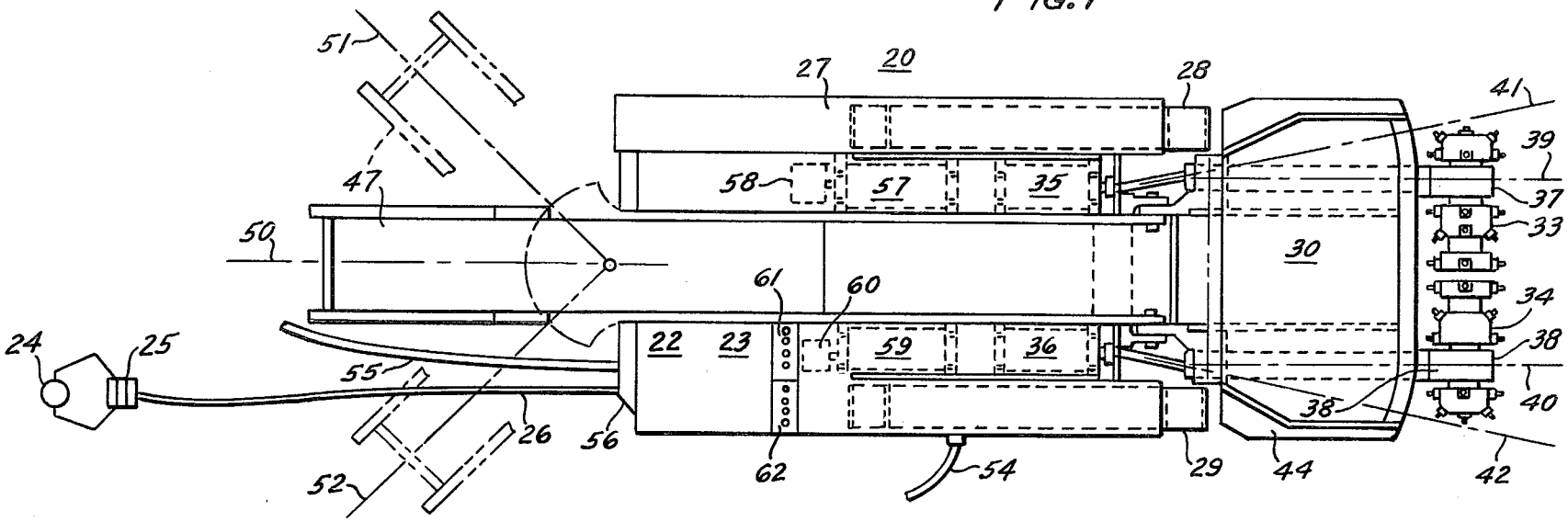
FIG. 1 is a plan view of a continuous miner which incorporates the present invention.
Figure 2:
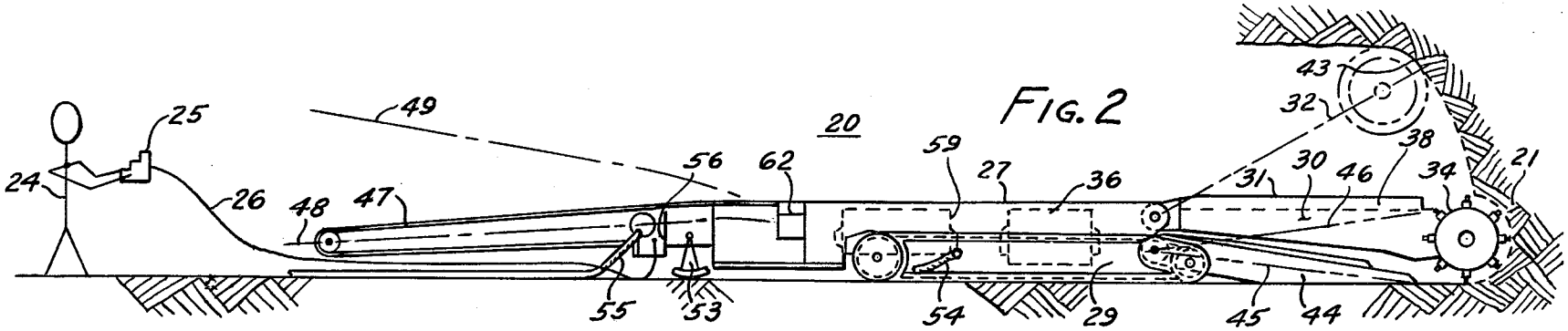
FIG. 2 is an elevational view of the FIG. 1 continuous miner.

Referring now to the drawings, particularly FIGS. 1 and 2, there is shown miner 20 exemplified as a Lee-Norse Co. continuous mining machine in an underground coal mine having a coal seam 21. Miner 20 includes a miner electrical system 22 and a miner hydraulic system 23 shown diagrammatically in FIG. 3 and is modified to be remotely controlled from an intrinsically safe, hand-held miner remote control pendant 25 by way of cable 26 trailing miner 20 a safe distance. With the trailing pendant 25, deeper than traditional cuts may be safely made into coal seam 21 by operator 24 before moving miner 20 to a different mine site. A traditional manual operating position not shown is far more hazardous and offers less controllability of miner 20 because operator 24 is normally couched at the right rear corner of miner 20 between machine upper and lower extremities while plying coal from seam 21.

Miner 20 includes chassis 27 which is supported by left tram 28 and right tram 29 which are driven by hydraulic motors not shown. Chassis 27 pivotally supports cutter boom 30 which is powered by a hydraulic cylinder not shown to be raised from a down position 31 to an up position 32. Cutter boom 30 pivotally supports left cutter head 33 and right cutter head 34, each being driven by a separate high voltage electric motor 35, 36, respectively, and both moved vertically whenever cutter boom 30 is raised and lowered. Left and right cutter heads 33, 34 are mounted on pivotal cutter head arms 37, 38 which are caused to oscillate horizontally in unison from their inward positions 39, 40 to their outward positions 41, 42 by a hydraulically powered mechanism not shown but disclosed, for example, in U.S. Pat. No. 3,460,868 to T. Luksich. In this manner, coal seam 21 is mined to a width greater than the nominal width of miner 20, and with the hydraulic means for raising cutter boom 30 to position 32 the coal seam 21 is mined to a height 43 which is greater than the nominal height of miner 20.

Also pivotally supported from miner chassis 27 is gathering pan 44 which has a hydraulically powered mechanism not shown for gathering coal cut from seam 21. Gathering pan 44 is raised and lowered between its down position 45 and its up position 46 by a hydraulic cylinder not shown. Coal gathered by pan 44 is fed to conveyor 47 which is powered for reversible operation by a hydraulic motor not shown. Conveyor 47 is pivotally supported from chassis 27 and is raised and lowered between its down position 48 and up position 49 by a hydraulic cylinder not shown. In addition, conveyor 47 tail is pivoted to swing horizontally from its center position 50 to its left or right positions 51, 52 by another hydraulic cylinder not shown. In this manner, coal cut from seam 21 may be discharged rearwardly from conveyor 47 at a variety of elevations and in a variety of directions within seam 21 onto a bolter-conveyor not shown.

If, during the course of mining seam 21, miner 20 develops an unstable operation force condition, stabilizing jack 53 may be lowered from chassis 27 to contact seam 21 as shown in FIG. 2 by still another hydraulic jack not shown. Otherwise, stabilizing jack 53 should be retained in its upward position. Also during operation of miner 20, the customary water spray and water deluge requirements are supplied by way of water hose 54, but are controlled remotely by pendant 25 as will be described below.

Figure 3:
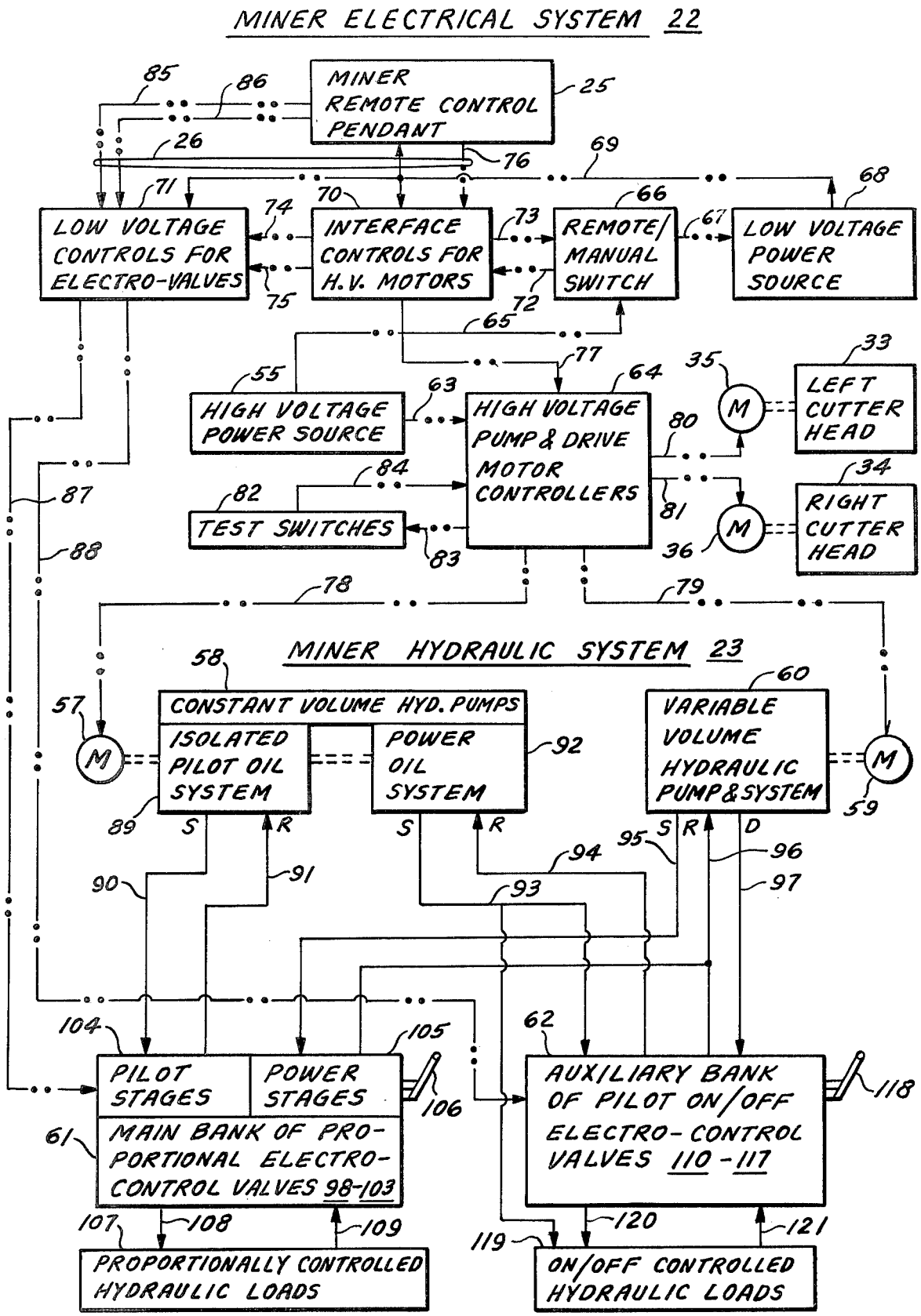
FIG. 3 is a block diagram of the combined electrical and hydraulic systems of the FIG. 1 continuous miner.

Miner electrical system 22 is fed 460 VAC high voltage over power cable 55 to explosion-proof enclosure 56 from which it is distributed to high voltage motor controllers and other devices not shown in FIGS. 1 and 2 but shown diagrammatically in FIG. 3. Included are electric drive motors 35, 36 for driving cutter heads 33, 34, respectively, which, in addition to electrically driven pumps, are the only loads having direct electrical drive.

In miner hydraulic system 23, electric motor 57 drives dual constant volume hydraulic pumps 58 and electric motor 59 drives a variable volume hydraulic pump and sytem 60. Hydraulic pumps 58, 60 are connected to a main bank of proportional electro-hydraulic control valves 61, to an auxiliary bank of on/off electro-hydraulic control valves 62, and to other loads not shown in FIGS. 1 and 2, but shown diagrammatically in FIG. 3.

Figure 7B:
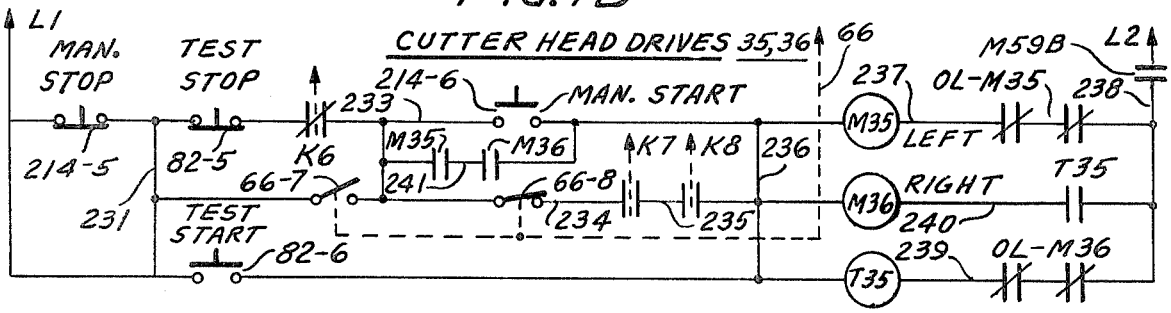
Figure 8A:
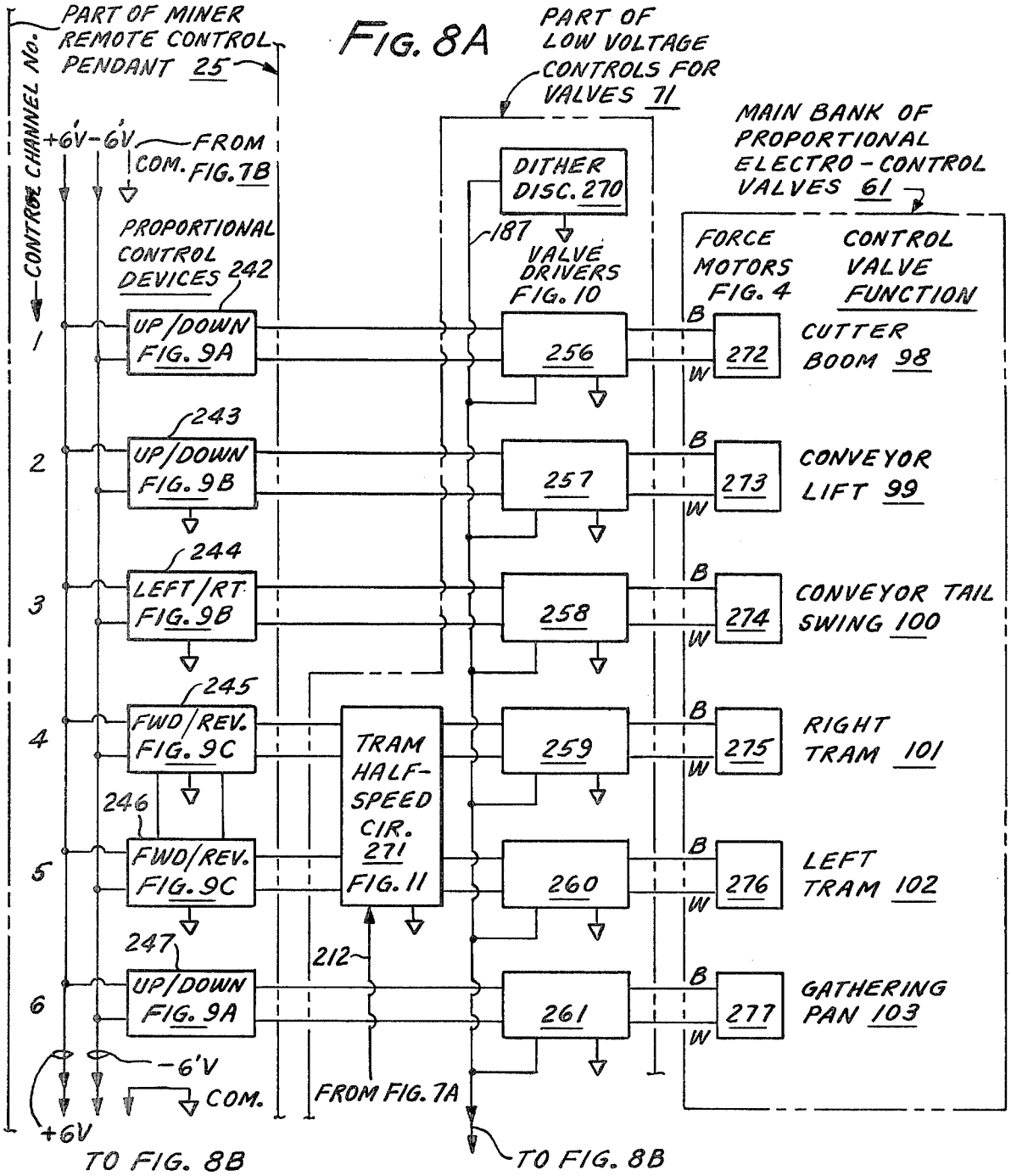
FIGS. 8A and 8B are electrical block diagrams of the remaining portion of the miner remote control pendant, low voltage valve controls and proportional and on/off banks of electro-control valves which perform hydraulic control functions.
Figure 8B:
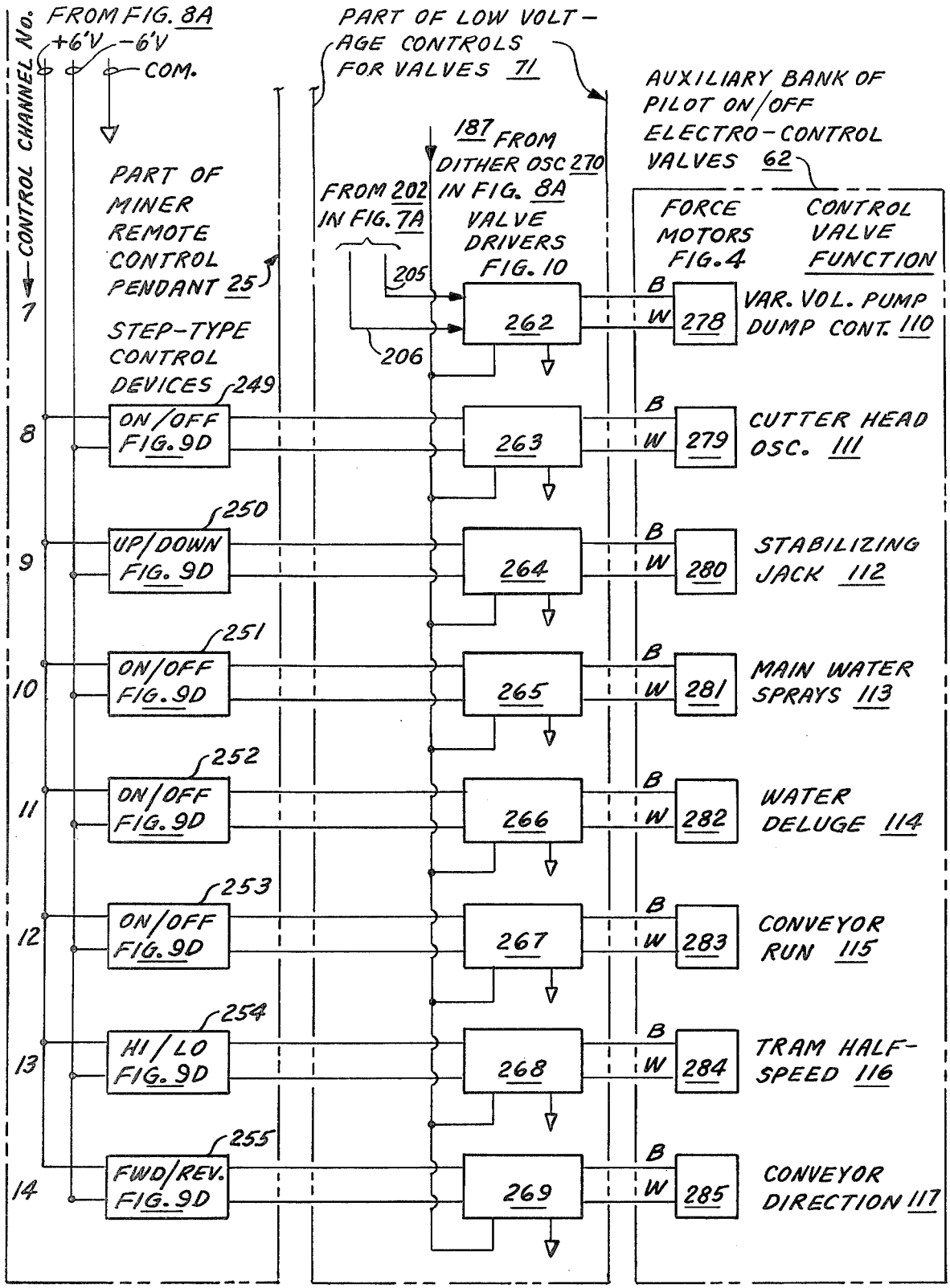

Referring now to FIG. 3, the miner electrical system 22 includes high voltage being fed from power source 55 over cable 63 to high voltage pump and drive motor controller 64. In addition, high voltage is fed over cable 65 to an eight-pole remote/manual switch 66 which determines whether miner 20 is to be operated in either remote or manual mode as will be explained below. High voltage from remote/manual switch 66 is fed over cable 67 to the input of low voltage power source 68 which, as shown in FIG. 6, produces an intrinsically safe ±6 VDC low voltage outut on cable 69. This low voltage source is fed to miner remote control pendant 25, low voltage interface controls for high voltage (H.V.) motors 70, and low voltage controls for electro-valves 71, all as shown in FIGS. 7A, 8A and 8B and described below.

Referring to remote/manual switch 66 also is involved in start and stop functions of the high voltage motors noted above by way of cables 72, 73 to and from interface controls for high voltage motors 70. Interface controls 70 provides low voltage signals related to pump dump control on cable 74 and tram half-speed control on cable 75 to low voltage control for electro-valves 71 as described below.

Miner remote control pendant 25 has two control devices which generate intrinsically safe low voltage on/off signals, one for pump drives and the other for cutter drives. These on/off signals are fed over cable 76 to interface controls 70 where solid state relays convert them into high voltage start and stop signals. The start and stop signals are over cable 77 to control high voltage pump and drive controller 64. Consequently, pendant 25 intrinsically safe low voltage on/off control signals cause high voltage controller 64 to remotely start and stop pump motors 57, 59 through cables 78, 79, and left and right cutter head drive motors 35, 36 through cables 80, 81. Test switches 82 verify solid state device activity in interface controls 70 by providing manual local high voltage start and stop control signals for controller 64 by way of cables 83, 84. Circuit details for remote control of pump and cutter head drive motors from pendant 25 are shown in FIGS. 7A and 7B.

Miner remote control pendant 25 also has fourteen control devices which generate fourteen intrinsically safe low voltage differential proportional and on/off control signals representing fourteen remotely controlled hydraulic functions on miner 20. Pendant 25 control device circuitry is shown in FIGS. 9A–9D. A first group of six differential proportional control signals are applied to cable 85 and a second group of eight differential on/off control signals are applied to cable 86, both cables being connected to low voltage controls for electro-valves 71. Cables 85, 86 and 69, 76 comprise pendant trailing cable 26 mentioned above.

Figure 10:
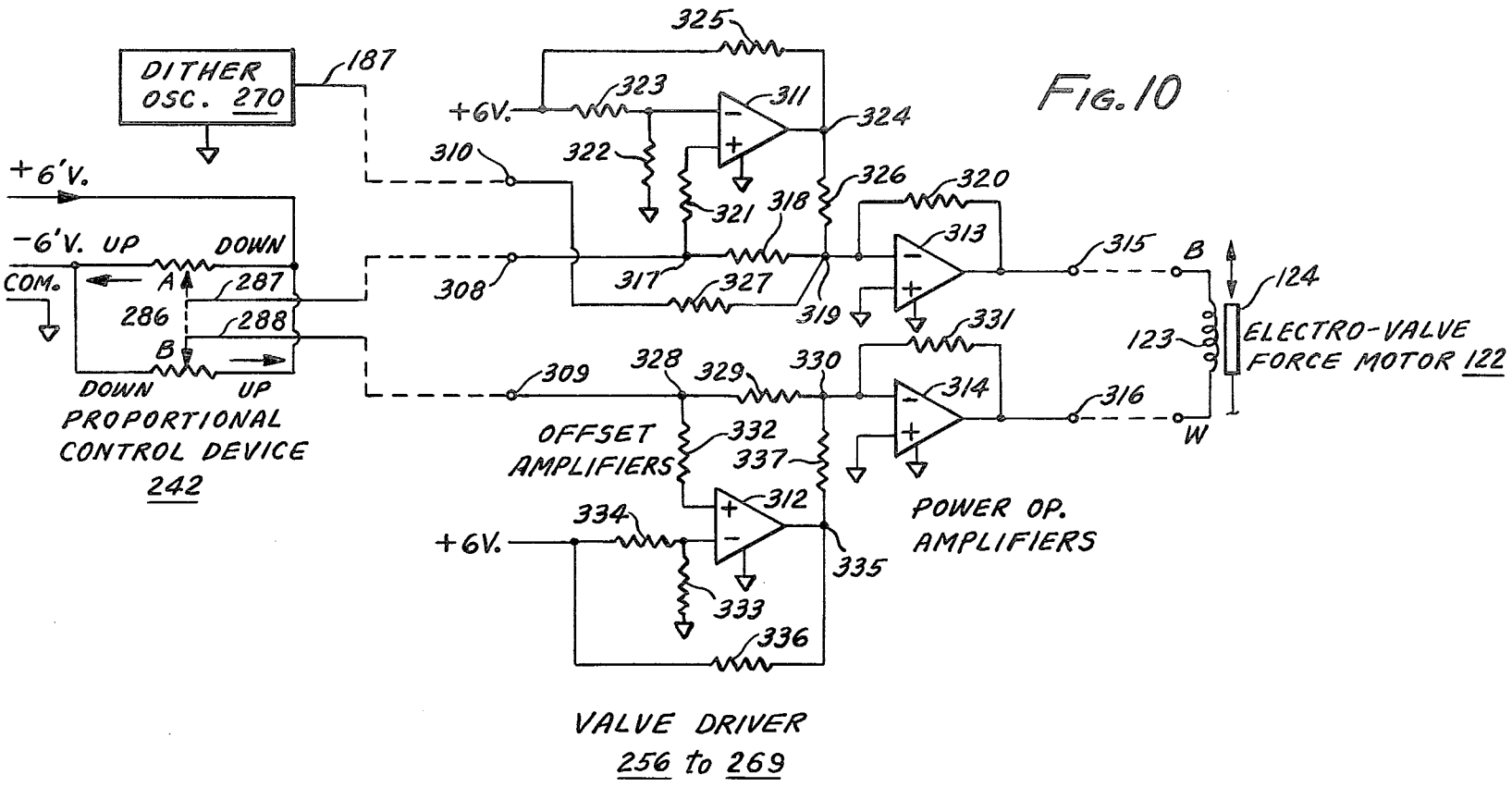
FIG. 10 is an electrical schematic diagram of the differential valve drivers used to power a force motor on a pilot stage valve in response to, for example, a differential proportional control device, the valve driver having offset and dither features for producing an output signal characterized in FIG. 5.

Each of the fourteen control signals fed over cables 85, 86 is connected in device 71 to an input of a different one of fourteen intrinsically safe electronic differential valve drivers of like design. Each valve driver differential input is circuited to sum the proportional or on/off signal with both an internal offset signal component initiated by monitoring pendant control position and an internal dither signal component. In this manner, each valve driver differential output signal is modified by offset and dither components to overcome valve dead band and frictional characteristics as well as contamination effects. FIG. 10 shows the valve driver circuitry.

Each valve driver in device 71 is included in one of the control channels 1 to 14 which correspond to fourteen miner hydraulic control functions diagrammed in FIGS. 8A and 8B. Control channels 1 to 6 have proportional valve driver output signals applied to cable 87 and control channels 7 to 14 have on/off valve driver output signals applied to cable 88. Cables 87, 88 are connected to intrinsically safe low voltage differential force motors associated with control channels 1 to 6 and 7 to 14 associated with electro-control valve banks 61, 62, respectively.

MINER HYDRAULIC SYSTEM

Still referring to FIG. 3, miner hydraulic system 23 includes dual constant volume hydraulic pumps 58 driven by electric motors 57 and variable volume hydraulic pump and system 60 driven by electric motor 59. Dual pumps 58 consist of isolated pilot oil pump and system 89 having supply (S) and return (R) lines 90, 91, and a power oil system 92 having supply (S) and return (R) lines 93, 94. Variable volume hydraulic pump and system 60 has supply (S) and return (R) lines 95, 96, and dump control (D) line 97 for relieving pump pressure before starting motor 59.

Pilot oil system 89 is completely isolated from all other oil systems in miner hydraulic system 23, thereby minimizing severe contamination effects caused in prior art remote control systems which normally used a miner power oil system for both power and control valve supply and return sources. In the present isolated pilot oil system 89, system filtering not shown in provided in both supply and return lines 90, 91 to keep contaminants at a minimum level where their effects are predicable and therefore accountable in valve driver construction. Also not shown for each isolated pilot oil, power oil and variable volume hydraulic system 89, 92, 60 are valving, tanks, oil coolers and the like as required to provide separate respective hydraulic systems on miner 20.

Main valve bank 61 contains six proportional electro-control valves 98 to 103, each having a pilot stage 104 coupled to a power stage 105 which is coupled to manual override 106, all as shown in FIG. 4. Pilot stage 104 includes a differential force motor not shown in FIG. 3 which receives a different one of the valve driver proportional output signals on cable 87. All six pilot stage 104 supply and return ports are manifolded to isolated pilot oil supply and return lines 90, 91. All six power stage pressure and tank ports are separately manifolded to variable volume system supply and return lines 95, 96. Electro-control valves 98–103 are connected directly to proportionally controlled hydraulic loads 107, listed in TABLE 1 below, which are powered through a plurality of supply and return lines shown simply as lines 108, 109.

Auxiliary valve bank 62 contains eight pilot on/off valves 110–117, each having a pilot stage like pilot stage 104 and a manual override 118 like manual override 106. Each pilot stage includes a differential force motor which receives a different one of the valve driver on/-off output signals on cable 88. Seven of eight pilot stage supply and return ports are manifolded to constant volume power oil system supply and return lines 93, 94. The eighth pilot stage supply and return ports are connected to variable volume dump (D) and return (R) lines 97, 96 to relieve hydraulic pressure on pump 60. Electro-control valves 110–117 have their pilot stage spools connected to other hydraulic valves, mechanisms, cylinders and the like required for on/off controlled hydraulic loads 119 also listed in TABLE 1 below. These loads are powered through a plurality of supply and return lines shown simply as lines 93, 120, 121.

TABLE I

| Control Channel No. | Electro-Control Valve No. | Miner Hydraulic Control Valve Function |
|---|---|---|
| | PROPORTIONAL CONTROL | |
| 1 | 98 | Cutter Boom 30 - Up 32/Down 31 |
| 2 | 99 | Conveyor Lift 47 - Up 49/Down 48 |
| 3 | 100 | Conveyor Tail Swing 47 - Left 51/Right 52 |
| 4 | 101 | Right Tram 29 - Forward/Reverse |
| 5 | 102 | Left Tram 28 - Forward/Reverse |
| 6 | 103 | Gathering Pan 44 - Up 46/Down 45 |
| | ON/OFF CONTROL | |
| 7 | 110 | Variable Volume Pump 62 - Dump Control 97 |
| 8 | 111 | Cutter Head 33, 34 Oscillator - On/Off |
| 9 | 112 | Stabilizing Jack 53 - Up/Down |
| 10 | 113 | Main Water Sprays - On/Off |
| 11 | 114 | Water Deluge - On/Off |
| 12 | 115 | Conveyor 47 Run - On/Off |
| 13 | 116 | Tram Half-Speed - High/Low |
| 14 | 117 | Conveyor 47 Direction - Forward/Reverse |

Turning now to FIG. 4, there is shown in schematic cross-section a typical proportional electro-control valve 98–103 having hydraulic servo-type pilot stage 104, a power stage 105 and a manual override 106, all mechanically coupled together. For simplicity of illustration, details of valve or shaft seals or other manufacturing details are not shown.

Included in hydraulic servo-type pilot stage 104 is an intrinsically safe differential force motor 122 having a differential electrical coil 123 and a vertically moving armature 124 which cooperates with coil 123 from a center or neutral deenergized position as shown. Coil 123 is rated at ±10 VDC and is equipped with black (B) and white (W) terminals which receive one of the differential proportional driver output signals on cable 87 mentioned above. Differential operation occurs when B+ and W−, armature 124 moves upward from the neutral position; when B− and W+, armature 124 moves downward from the neutral position.

Hydraulic servo-type pilot stage 104 also includes a pilot valve body 125, a supply port 126 and a return port 127 being connected, through manifolding not shown, to respective isolated pilot oil supply and return lines 90, 91 shown in FIG. 3. Supply port 126 is connected through filter screen 128 to supply passageway 129 which leads to a vertical pilot spool bore 130. A mechanical feedback sleeve 131 slidably fitted in vertical pilot spool bore 130 has a lower cone end 132 biased by sleeve spring 133 against pilot piston 134 at a central region of feedback cone 135.

Pilot piston 134 is provided with pull and push pilot piston heads 136, 137, respectively, which are slidably fitted in horizontal pilot piston bore 138. Opposing faces of pull and push piston heads 136, 137 communicate through respective first and second control passageways 139, 140 to opposite acting regions of feedback sleeve 131. Adjacent faces of pull and push piston heads 136, 137 communicate directly to return port 127. Pilot piston output connection 141 transmits double acting valve operating forces from pilot piston 134 in pilot stage 104 to other loads such as power stage 105.

In order to produce double acting forces at pilot piston output connection 141, mechanical feedback sleeve 131 is provided with four feedback sleeve lands 142, 143, 144, 145 and three sets of sleeve radial ports 146, 147, 148 located between the four sleeve lands and aligned for communication individually with second control passageway 140, supply passageway 129 and first control passageway 139, respectively, during pilot stage 104 operation. Fluid passage through the radial ports and related passageways and its action on pilot piston 134 will be described below.

Slidably fitted coaxially within mechanical feedback sleeve 131 is hollow pilot spool 149 having an upper end pinned to force motor armature 124 and a lower end biased by pilot spool spring 150 against the interior cone end 132 of mechanical feedback sleeve 131. Pilot spool 149 is provided with upper, center and lower lands 151, 152, 153, respectively, and first and second drain orifices 154, 155 which are drilled through the wall and into the hollow of pilot spool 149. First and second pilot control chambers 156, 157 are established in the two spaces between center and lower lands 152, 153 and center and upper lands 152, 151, respectively.

As shown in the enlarged insert of FIG. 4, pilot spool center land 152 is so configured as to provide first and second small leakage openings 158, 159 which are equally positioned with feedback sleeve center radial port 147 when pilot spool 149 is in either a neutral or a null position. First and second leakage pathways are established when supply fluid entering feedback sleeve center radial port 147 leaks two ways. That is, through leakage openings 158, 159, first and second pilot control chambers 156, 157, first and second drain orifices 154, 155, respectively, and into the hollow of pilot spool 149 where the two leakage paths combine into one. The single leakage path flows through feedback sleeve radial drain holes 160 at the cone and 132 of sleeve 131, into pilot piston drain chamber 161 between inside faces of pull and push piston heads 136, 137, and then flows to pilot valve return port 127.

In addition, first and second control pathways are also established when supply fluid entering feedback sleeve center radial port 147 either leaks or flows into two other pathways in addition to the two leakage pathways, that is, through leakage openings 158, 159, first and second pilot control chambers 156, 157, first and second control passageways 139, 140 and opposing faces of pilot piston pull and push piston heads 136, 137, respectively. Operation of the aforesaid pilot stage 104 components as they affect both the leakage and control pathways will be described below.

Still referring to FIG. 4 electro-control valve construction, power stage 105 is of a four-way valve construction, including a power valve body 162, a pressure (P) supply port 163 and two tank (T) return port 164, 165 being connected, through manifolding not shown, to respective variable volume oil system supply and return lines 95, 96 shown in FIG. 3. Supply port 163 leads to a horizontal power spool bore 166 wherein a power spool 167 is slideably fitted in axial alignment with pilot piston bore 138. Power spool 167 has an input stem 168 coupled to the pilot piston output connection 141, four axially spaced lands 169, 170, 171, 172, an output stem 173 and a power spool output/input connection 174.

Power stage 105 outflow is handled by cylinder 1 and cylinder 2 ports 175, 176 which are sealably aligned with power spool lands 170, 171 when power spool 167 is in neutral position as determined by the position of pilot piston 134. A B+ voltage on coil 123 in force motor 122 causes pilot piston 134 to pull power spool 167 to the left. Initial leftward movement or pretravel of power spool 167 eliminates the offset between face 177 of land 170 and leading edge 178 of cylinder 1 port 175, while increasing the offset between face 179 of land 171 and leading edge 180 of cylinder 2 port 176. Additional leftward movement of power spool 167 by pilot piston 134 will open land 170 and permit proportional outflow from supply port 163, through cylinder 1 port 175, to a proportionally controlled hydraulic load 107 shown in FIG. 3. Simultaneously, additional leftward movement of power spool 167 will open land 171 and permit proportional backflow through cylinder 2 port 176 to return port 165.

A B− voltage on coil 123 in force motor 122 causes pilot piston 134 to push power spool 167 to the right. Initial rightward movement or pretravel of power spool 167 eliminates the offset between face 179 of land 171 and leading edge 180 of cylinder 2 port 176, while increasing the offset between face 177 of land 170 and leading edge 178 of cylinder 1 port 175. Additional rightward movement of power spool 167 by pilot piston 134 will open land 171 and permit proportional outflow from supply port 163, through cylinder 2 port 176, to the proportionally controlled hydraulic loads 107 shown in FIG. 3. Simultaneously, additional rightward movement of power spool 167 will open land 170 and permit proportional backflow through cylinder 1 port 175 to return port 164.

A zero voltage on force motor coil 123 will cause pilot piston 134 and power spool 167 to assume a neutral position between offsets. This position causes spool lands 170, 171 to block both proportional outflow and backflow through cylinder 1 and 2 ports 175, 176 to and from external hydraulic loads 107. Conversely, a full B+ or B− voltage on force motor coil 123 will cause pilot piston 134 to assume a full pull or push position and correspondingly power spool 167 to a full outflow position for cylinder 1 or 2 ports 175, 176. This causes a full outflow and backflow through cylinder 1 or 2 ports 175, 176 to and from external hydraulic loads 107.

A manual override 106 is provided in each electrohydraulic control valve 98–103 for use to control miner 20 proportional control functions listed in Table 1 when electronic control signals may fail, or when remote/-manual switch 66 shown in FIG. 3 is placed in the manual operating position as described below. Manual override 106 includes a manual hinge fitting 181 mounted on valve body 162. An operating arm 182 is provided with one end pivoted through pin 183 in hinge fitting 181 and the other end fitted with a knob 184 for hand operation.

Included is double-acting spring bias mechanism 185 located in axial alignment with horizontal power spool bore 166 and adapted to cooperate with power stage body 162 and power spool 167. Double-acting mechanism 185 is engaged with power spool end connection 174 and pin 186 in operating arm 182 to self-center power spool 167 to a neutral position. When pushing to the left on knob 184, pilot spool 167 causes outflow through cylinder 1 port 175 and backflow through cylinder 2 port 176. When pulling to the right on knob 184, pilot spool 167 operates oppositely and causes outflow through cylinder 2 port 176 and backflow through cylinder 1 port 175. When knob 184 is released, or no effort applied thereto, manual override 106 causes the four-way valve action of power stage 105 to return to a center neutral position.

Referring to FIGS. 3 and 4, pilot on/off electrocontrol valves 110–117 in auxiliary valve bank 62 perform the channel 7 to 14 miner hydraulic on/off control functions listed in TABLE 1. Each pilot on/off electrocontrol valve 110–117 has the same construction and operating features as the FIG. 4 pilot stage 104 described above with two exceptions mentioned below. Each force motor 122 electrical input signal is derived from cable 88.

As for the first exception to pilot stage 104 construction, there is no power stage 105, so that manual override 118, which is the same as device 106, is connected to operate on pilot piston 134 instead of power spool 167. Each pilot piston is connected to an external hydraulic load 60 and 119 and may have a stem extended for this purpose. Second, on pilot on/off electro-control valve 110 supply and return ports are connected to variable volume pump and system 60 dump control and return lines 97, 96, respectively, to relieve pump pressure during starting of electric motor 59. The remaining pilot on/off electro-control valves 111-117 have their supply and return ports manifolded as described above, except they are connected to constant volume power oil system 92 supply and return lines 93, 94, respectively.

Otherwise, the pilot on/off electro-control valves 110–117 have intrinsically safe force motors 122 which receive control channel 7 to 14 on/off control signals over cable 87 from valve drivers in low voltage valve controls 71. These valve drivers receive on/off control signals from pendant 25 over cable 86 and modify each valve driver output signal with offset and dither components as well. In this way, all valve drivers, pilot stages and manual overrides are interchangable with respective devices to perform both proportional and on/off control functions. This is a tremendous advantage in regards to maintaining miner 20 remote control functions underground in a hazardous environment.

Operation of pilot stage 104 hydraulic servo employed in all electro-control valves 98 to 103 and 110 to 117 present in main and auxiliary valve banks 61, 62 will now be described. Reference will be made to a pilot stage 104 having a proportional load consisting of power stage 105 and manual override 106 with dual-action spring bias to neutral in control channels 1 to 6 as opposed to simply on/off loads that occur in control channels 7 to 14. In addition, reference will also be made to FIG. 5 graph in which curve 186 represents FIG. 4 electro-control valve proportional operating characteristics less extreme ends in terms of power stage 105 valve outflow through cylinder 1 and 2 ports 175, 196 vs. power spool position, including power spool offset or pretravel resulting in power stage 105 dead band.

Curve 186 in FIG. 5 also illustrates power stage 105 outflow vs. force motor 122 voltage and polarity applied to coil 123 "B" terminal, including offset and dither signal 187 components incorporated in valve driver output signals as required to overcome offset or pretravel, frictional, and contamination characteristics of the load in pilot stage 104. As shown in FIG. 5 inset, dither signal 187 component has a constant amplitude square wave present at all times, even when the proportional control signal summed therewith is zero.

Pilot oil entering supply port 126 continuously flows through filter 128, supply passageway 129, the first and second leakage pathways described above, into pilot piston drain chamber 161 and out of return port 127. When there is no electrical signal applied to force motor 122, pilot spool 149 is in both a neutral and null position and center land 152 is aligned with the center or supply port 147 on mechanical feedback sleeve 131. Equal low-level pressures develop in the first and second control pathways described above because equal amounts of supply oil bleed off through the first and second leakage pathways. As a result, equal low-level pressures act on pull and push piston heads 136, 137 of pilot piston 134 to maintain a central or off position. Feedback sleeve 131 is biased by spring 133 so that cone end 132 maintains a null position in the servo loop at the center of pilot piston feedback cone 135.

When force motor 122 receives a proportional B+, W− electrical signal, pilot spool 149 moves upward a distance directly proportional to the magnitude of the electrical signal. The second leakage pathway is blocked momentarily and the first leakage pathway is increased momentarily. This action results in a pressure differential favoring the first control pathway, thereby causing a pressure differential across pilot piston pull and push heads 136, 137 that cause pull head 136 to move pilot piston 134 leftward and pull on power stage spool 167. Leftward movement of pilot piston cone 135 causes feedback sleeve 131 to rise, tending to reduce the momentary leakage pressure differential in favor of the first control pathway. Movement of pilot piston 134 and feedback sleeve 131 continue slowly until the pilot stage 104 hydraulic servo stabilizes at a null position between pilot spool center land 152 and feedback sleeve supply port 147.

The null position is reached off-center or neutral when the first leakage opening 158 is slightly larger than the second leakage opening 159 as opposed to having equal openings at the neutral position described above. A differential control pressure results in favor of the first control pathway with sufficiency to provide pilot piston 134 with enough pulling force by head 136 to overcome the centering effort of double-acting spring mechanism 185 in manual override 106. Pilot piston 134 is maintained static at the null position by the differential control pressure favoring pull piston head 136 as long as the same magnitude of electrical signal is applied to force motor 122. In addition, power stage spool 167 maintains the leftward position established by pilot piston 134, thereby causing an outflow through cylinder 1 port 175, and a backflow through cylinder 2 port 176, proportional to the magnitude of the B+, W− electrical signal applied to force motor 122.

When force motor 122 receives a proportional B−, W+ electrical signal from a valve driver, pilot stage 104 hydraulic servo loop operates just the opposite of that described above for B+, W− electrical signal. That is, pilot spool 149 moves downward a distance proportional to the magnitude of the electrical signal. The first leakage pathway is blocked momentarily and the second leakage pathway is increased momentarily. This action results in a pressure differential favoring the second control pathway, thereby causing a pressure differential across pilot piston push and pull heads 136, 137 that causes push head 137 to move pilot piston 134 rightward and push on power stage spool 167. Rightward movement of pilot piston cone 135, together with biasing spring 133, cause feedback sleeve 131 to lower, tending to reduce the momentary leakage pressure differential in favor of the second control pathway. Movement of pilot piston 134 and feedback sleeve 131 continue until the pilot stage 104 hydraulic servo stabilizes at a null position the opposite as described above.

When reaching the downward null position, a differential pressure favoring the second control pathway is sufficient to provide pilot piston 134 with enough pushing power rightward to overcome the centering effor of double-acting spring biasing mechanism 185. Pilot piston 134 is maintained static at the null position until the magnitude of electrical signal is changed at force motor 122. In addition, power stage spool 167 maintains the rightward position established by pilot piston 134, thereby causing an outflow through cylinder 2 port 176, and a backflow through cylinder 1 port 175, proportional to the magnitude of the B−, W+ electrical signal applied to force motor 122.

Thus, it has been shown how pilot stage 104 hydraulic servo performs a differential proportional control function at power stage 104 valving when a differential electrical signal B+, W− or B−, W+ is applied to force motor 122.

One additional characteristic of the electrocontrol valves used in the present invention will now be described. During normal operation, a dither signal 187 component of the valve driver output is applied to each force motor 122. The purpose of the dither signal is to minimize frictional characteristics of each valve's moving parts and to minimize, or eliminate if possible, the effects of oil contaminants on valve moving parts. In most instances the dither signal performance is very good. However, if oil contamination should occur that would completely block one of the leakage openings 158, 159, the pilot piston 134 will return to center neutral position. This is because the leakage flow in the remaining leakage pathway at an off-neutral null position is not large enough to produce a control pressure in the remaining control pathway high enough to overcome the force exerted by the centering effort of dual-acting biasing spring mechanism 185.

MINER ELECTRICAL SYSTEM

The miner electrical system 22 shown diagrammatically in FIG. 3 will now be described by referring to FIGS. 6–11. As noted above, the remote control system of this invention is made intrinsically safe by transforming 460 VAC high voltage to a lower voltage in an explosion-proof housing. One example of this is low voltage power source 68 shown in FIG. 6 block diagram. Here step-down transformer 188 receives 460 VAC from high voltage source 66 over cable 67 and reduces it to a lower voltage of say 115 VAC output at leads 189, 190. The 115 VAC on leads 189, 190 is fed to the inputs of +7 VDC and −7 VDC conventional solid-state power supplies 191, 192, each having an earth grounded input lead and a common grounded output lead. The other output leads 193, 194 of +7 VDC and −7 VDC power supplies 191, 192 are fed to respective intrinsically safe barriers 195, 196.

Each barrier 195, 196 in low voltage power source 68 consists of rugged selectable series-parallel connected voltage dropping resistors which limit low voltage output to all electronic loads to a safe +6 V, −6 V and a common connection, respectively. The +6 V, −6 V and common leads form cable 69 which provides intrinsically safe low voltage power requirements to miner remote control pendant 25, interface controls 70 and low voltage controls for electrovalves 71 as shown in FIGS. 8 to 11 and described below.

As shown in FIG. 7A, the +6 V and −6 V conductors are switched on and off in miner remote control pendant 25 by power-on switch 197. This switch controls low voltage power fed to all control devices in pendant 25 and consequently acts as a master switch for all remote control functions on miner 20. On the load side of power-on switch 197 in FIG. 7A, as well as devices in FIGS. 8A, 8B, 9A to 9D and 10, the low voltage conductors to control devices and valve drivers and the like are identified as +6′ V and −6′ V to distinguish them from the unswitched +6 V and −6 V conductors ahead of power-on switch 197.

Miner remote control pendant 25 includes two momentrary D.P.D.T. control switches 198, 199 labeled pumps and cutter heads, respectively. When remote/-manual switch 66 is selected for remote mode of miner 20 operation, control switches 198, 199 provide separate remote on and off control signals to solid-state relays in interface controls 70. These on and off control signals cause solidstate relay contacts in interface controls 70 to parallel local manual start and stop control action in high voltage pump and drive motor controllers 64. As will be described below, this circuit arrangement provides an operator with means on pendant 25 for remotely controlling both the operation of pump motors 57, 59 from switch 198 and cutter head drive motors 35, 36 from switch 199.

The solid state relays and other devices in interface controls 70, as well as motor starters and other devices in high voltage pump and drive motor controller 64, are housed in an explosion-proof enclosure on miner 20 to comply with mine safety requirements.

During a momentary on closure of pump switch 198, one pole feeds a momentary +6′ V signal over led 200 to the inputs of solid-state start relays K4, K5. Relays K4, K5 momentarily close their normally open contacts in the constant volume pump motor 57 (CVP-M57) control circuit described below. The momentary +6′ V signal on lead 200 is also fed to the inputs of electronic circuits consisting of adjustable time delay on energize 201, adjustable time delay on deenergize 202 and latch circuit 203. After a predetermined time delay, time delay circuit 201 feeds the momentary +6′ V signal over lead 204 to the input of solidstate start relay KK2. Relay K2 momentarily closes its normally open contact in the variable volume pump motor 59 (VVP-M59) control circuit also described below.

Further, the momentary +6′ V signal on lead 200 causes time delay on deenergize 202 to immediately feed a differential dump control signal isolated from ground over leads 205, 206 to the input of a valve driver in control channel 7 shown in FIG. 8B. The dump control signal is maintained at the output of device 202 for a predetermined delay after deenergizing its input. As will be explained below, the dump control signal on leads 205, 206 acts to momentarily relieve hydraulic pressure on the variable volume pump (VVP) 60 so that relay K2 may permit starting of pump motor 59 with a minimum of load during the deenergizing delay period.

In addition, the momentary +6′ V signal on lead 200 causes a capactior within latch circuit 203 to charge and inhibit both stop circuits of constant and variable volume pumps.

When a momentary off closure of pump switch 198 occurs, both poles are grounded and the latch circuit 203 input is grounded by way of lead 207. This enables latch circuit 203 which feeds a momentary +6′ V signal over lead 208 to the inputs of solid state stop relays K3, K1. Relays K3, K1 momentarily open their normally closed contacts in the constant volume pump motor 57 (CVP-M57) and variable volume pump motor 59 (VVP-M59) control circuits described below.

Further, the momentary grounding of pump switch 198 during a momentary off closure of both poles also resets time delay devices 201, 202 so they may be ready for circuit operation as described above.

During a momentary on closure of cutter head switch 199, one pole feeds a momentary +6′ V signal on lead 209 to the inputs of solid-state start relays K7, K8 and latch circuit 210. Relays K7, K8 momentarily close their normally open contacts in control circuits described below in connection with left and right cutter head motors 35, 36 (CHLT-M35 and CHRT-M36) respectively. The momentary +6′ V on lead 209 causes a capacitor in latch circuit 210 to charge and inhibit the stop circuit for both cutter heads.

When a momentary off closure of cutter head switch 199 occurs, both poles are grounded and the latch circuit 210 input is grounded through lead 211. This enables latch circuit 210 which feeds a momentary +6′ V signal over lead 212 to solid-state stop relay K6. Relay K6 momentarily opens its normally closed contact in the cutter head drive motor control circuits 35, 36 described below (CHLT-M35 and CHRT-M36).

Further, during the momentary off closure of cutter head switch 199, the momentary +6′ V signal on cutter head stop circuit lead 212 is fed to the input of a tram half-speed circuit described below with reference to FIG. 8A. This signal causes tram forward speed to be automatically reduced to half-speed when cutter head drive motors 35, 36 are not stopped, and to return to tram full speed when cutter heads are not being driven.

In addition, a momentary D.P.S.T. mushroom-head pushbutton switch 213 labeled emergency stop ceases operation of all pump and cutter head drive motors 57, 59, 35, 36, simultaneously. Both poles of switch 213 are grounded on one side of the switch and the other side of each pole is wired to leads 207, 211 connected to the inputs of latch circuits 203, 210. When emergency stop switch 213 is closed momentarily, a momentary +6′ V signal energizes solid-state stop relays K1, K3, K6 as described above. Relays K1, K3, K6 all momentarily open their normally closed contacts and simultaneously deenergize the control circuit for all pump and cutter head drive motors as described below.

Still referring to FIGS. 7A and 7B, a description will now be made of all motor starter and control circuits in high voltage pump and drive motor controllers 64, and the interaction therewith of test switches 82, remote/- manual switch 66, and a bank of local manually operated pushbutton switches 214. Test switches 82-1 to 82-6 are momentary contact start and stop pushbuttons housed in a separate enclosure.

Independently of remote/manual switch 66 operating mode, test switches 82-1 to 82-6 permit activation of the control circuits for pump and cutter head drive motors 57, 59, 35, 36 as a means for determining whether solid-state start and stop relays K1 to K8 are functioning properly under remote control from miner pendant 25.

Local manually operated switches 214-1 to 214-6 are momentary contact start and stop pushbuttons housed in separate enclosures from test switches 82. When under manual operating mode of remote/manual switch 66, manual pushbutton switches 214-1 to 214-6 are arranged for local start and stop operations in the control circuits of all pump and cutter head drive motors 57, 59, 35, 36. In other words, manual pushbutton switches 214-1 to 214-6 provide local control in place of remote pump, cutter head, and emergency stop switches 198, 199, 213 on miner pendant 25. These switches, as well as all others on miner pendant 25, are deactivated when remote/manual switch 66 is placed in the manual mode of operation.

Control circuit power for controller 64 is derived from step-down transformer 215. Transformer 215 receives 460 VAC over cable 63 from high voltage source 55 and reduces it to, for example, a 230 VAC output. This output is fed to output leads L1 and L2 and through safety switch 216 to all pump and cutter head motor control circuits. 460 VAC is also fed over cable 65 from high voltage source 55 through normally closed contacts 66-1, 66-2 and over cable 67 to low voltage power source 67 described above in FIG. 6. Thus, when remote/manual switch 66 is changed from remote to manual mode, contacts 66-1, 66-2 open and deenergizes not only low voltage power supply 68 but the miner pendant 25 and all other intrinsically safe loads connected thereto.

The remote control mode for switch 66 shown in FIGS. 7A and 7B will first be described followed by the manual control mode. Regardless of which operating mode is selected there is a predetermined motor starting sequence which must be followed in order to minimize high voltage fluctuations from high voltage source 55 which would result from large changes in connected load. First, the constant volume pump motor 57 is started, second the variable volume pump motor 59 is started, third the left cutter head drive motor 35 is started, and fourth the right cutter head drive motor is started.

Constant volume pump motor 57 starts after pump switch 198 is turned on momentarily and current flows from L1 through manual stop pushbutton 214-1, lead 217, test stop pushbutton 82-1, lead 218, K3 relay normally closed contact, lead 219, normally closed switch 66-4, lead 220, and K4, K5 relay contacts momentarily closed by pump switch 198. The start current path continues through leads 221, 222, to motor starting coil M57 and time delay relay coil T57, through lead 223 and motor overload relay contacts OL-M57 to L2.

As soon as starter coil M57 becomes energized, normally open sealing contact M57 closes permanently to maintain a sealing current path directly from lead 219 to coils M57 and T57, thereby starting constant volume pump motor 57. The constant volume pump motor 57 and coils M57 and T57 remain energized even though normally open relay contacts K4, K5 experienced only a momentary closure. Time delay relay contacts T57 close after a predetermined time delay and are used in the sequential starting of variable volume pump motor 59 described below.

An alternate start current path for constant volume pump 57 is established when test start switch 82-2 is closed momentarily and current flows directly to coils M57, T57, through OL-M57 relay contacts and then to L2. Sealing contact M57 closes permanently when test start switch 82-2 is released, thereby maintaining pump motor 57 operation.

Constant volume pump motor 57 is stopped when pump switch 198 is turned off momentarily, thereby momentarily opening relay contact K3 and breaking the sealing current path through leads 219, 222 and sealing contacts M57 and deenergizing both coils M57 and T57. Alternatively, a momentary opening of either test stop switch 82-1 or motor overload relay contacts OL-M57 also breaks the sealing current pathway to coils M57 and T57, thereby deenergizing constant volume pump motor 57.

Variable volume pump motor 59 starts after constant volume pump motor 57 is running and after a time delay predetermined by device 203 when pump switch 198 is turned on momentarily and current flows from L1 through manual stop pushbutton 214-3, lead 224, test stop pushbutton 82-3, lead 225, normally closed relay K1 contact, lead 226, normally closed switch 66-6, lead 227 and K2 relay contact closed momentarily by pump switch 198. The start current path continues through leads 228, 229, T57 time delay sequence interlock contacts which close after pump motor 57 starts, to motor starter coil M59, through lead 230 and motor overload relay contacts OL-M59 to L2.

As soon as starter coil M57 becomes energized, normally open sealing contacts M59A and M59B close permanently to maintain a current path directly from lead 226 through interlock contact T57 to starter coil M59, thereby starting variable volume pump motor 59. The variable volume pump motor 59 and starter coil M59 remain energized through sealing contacts M59A even though normally open relay contacts K2 experience only a momentary closure, and as long as constant volume pump motor 57 is energized and contacts T57 remain closed. Sealing contacts M59B open and close with contacts M59A and are used in the sequential starting of left and right cutter head drive motors 35, 36 described below.

An alternate start current path for variable volume pump motor 59 is established when test start switch 82-4 is closed momentarily and current flows directly through contacts T57 to starter coil M59, overload relay contacts OL-M59 and to L2. Sealing contacts M59A close permanently when test start switch 82-4 is released, thereby maintaining pump motor 59 operation.

Variable volume pump motor 57 is stopped when pump switch 198 is turned off mementarily, thereby momentarily opening stop relay contact K1 and breaking the sealing current path through contact M59 and deenergizing starter coil M59. Alternatively, a momentary opening of either test stop switch 82-3 or motor overload relay contacts OL-M59 also breaks the sealing current pathway to starter coil M59.

Left and right cutter head drive motors 35, 36 start sequentially after constant and variable pump motors 57, 59 are running and after cutter head switch 199 is turned on momentarily and current flows from L1, through manual stop pushbutton 214-5, lead 231, test stop pushbutton 82-5, lead 232, normally closed K6 relay contact, lead 233, normally closed switch 66-8, lead 234 and K7, K8 relay contacts momentarily closed by cutter head switch 199. A single start current pathway through leads 235, 236 branches into three parallel pathways.

A first branch current pathway extends to left cutter head drive motor 35 starter coil M35, through lead 237, left motor 35 overload relay contacts OL-M35, lead 238 and variable volume pump motor 59 sealing interlock contact M59B to L2. A second branch current pathway extends to time delay relay coil T35, through lead 239, motor 36 overload relay contacts OL-M36, lead 238 and interlock contact M59B to L2. A third branch current pathway extends to right cutter head drive motor 36 starter coil M36, through lead 240, right motor 36 overload relay contacts OL-M36, lead 238 and interlock contact M59B to L2.

Left starter coil M35 becomes energized first and, after a short time delay determined by contact T35 closure time, right starter coil M36 then becomes energized. When starter coils M35, M36 become energized, normally open sealing contacts M35, M36 close permanently to maintain a sealing current pathway directly from lead 233 through sealing contacts M35, M36, lead 241 and lead 236 to coils M35, M36 and T35, thereby starting left and right cutter head motors 35, 36 sequentially under control of variable volume pump interlock contact M59B. The left and right cutter head drive motors 35, 36 and coils M35, M36, T35 remain energized even though normally open relay contacts K7, K8 experience only a momentary closure.

An alternate start current path for left and right cutter head drive motors 35, 36 is established when test start switch 82-6 is closed momentarily and current flows directly through lead 236 to coils M35, M36, T35 and other overload, time delay and interlock contacts in the three branch current pathways as described above. Sealing contacts M35, M36 close permanently when test start switch 82-6 is released, thereby maintaining left and right cutter head drive motors 35, 36 in operation.

Left and right cutter head drive motors 35, 36 are stopped when cutter head switch 199 is turned off momentarily, thereby momentarily opening stop relay contact K6 and breaking the sealing current pathway through contacts M35, M36 and deenergizing starter coils M35, M36. Alternatively, a momentary opening of test stop switch 82-5, or motor overload relay contacts OL-M35 or OL-M36, or variable volume pump 59 interlock contact M59B also breaks the sealing current pathway to starter coils M35, M36.

The manual control mode for switch 66 shown in FIGS. 7A and 7B will now be described. First, normally closed switches 66-1, 66-2 are opened and deenergize the low voltage power supply 68 and all intrinsically safe remote controls. Second, the normally closed switches 66-4, 66-6, 66-8 in the pump and drive motor control circuits are opened, and the normally open switches 66-3, 66-5, 66-7 therein are closed. This switching arrangement bypasses the solid-state relay contact K1 to K8 action as described above. All motors are started in the same sequence as described above.

The constant volume pump motor 57 is started by a momentary closure of manual start pushbutton 214-2 which energizes starter coil M57 and time delay coil T57 as described above. A sealing current pathway is maintained by sealing contacts M57 which bypass pushbutton 214-2. Pump motor 57 is stopped by a momentary opening of manual stop pushbutton 214-1, or any of the other methods described above, thereby breaking the sealing current pathway through sealing contacts M57 and deenergizing starter coil M57 and time delay coil T57.

The variable volume pump motor 59 is started in sequence after a time delay by a momentary closure of manual start pushbutton 214-4 which energizes starter coil M59 also as described above. A sealing current pathway is maintained by sealing contact M59 which bypasses pushbutton 214-4. Pump motor 59 is stopped by a momentary opening of manual stop pushbutton 214-3, or any of the other methods described above, thereby breaking the sealing current pathway through sealing contacts M59 and deenergizing starter coil M59.

The left and right cutter head drive motors 35, 36 are started in sequence with the variable volume pump 59 and each other by a momentary closure of manual start pushbutton 214-6 which energizes starter coils M35, M36, and time delay coil T35 also as described above. A sealing current pathway is maintained by sealing contacts M35, M36 which bypass pushbutton 214-6. Cutter head motors 35, 36 are stopped by a momentary opening of manual stop pushbutton 214-5, or by any other method described above, thereby breaking the sealing current pathway through sealing contacts M35, M36 and deenergizing starter coils M35, M36 and time delay coil T35.

Reference will now be made to FIGS. 8A, 8B block diagrams of the intrinsically safe miner remote control channels 1 to 14 whose functions are listed in TABLE 1. Each control channel operates at not more than ±6 VDC and will be described below. In addition to having the foregoing pump and cutter head on/off switches 198, 199, miner remote control pendant 25 also includes six FIGS. 9A–9C differential proportional control devices 242 to 247 with spring centered rotary levers, some of which incorporate a deadman switch, controlling channels 1 to 6. In addition, pendant 25 has seven FIG. 9D differential step type control devices 249 to 255 with spring centered toggles controlling channels 8 to 14. Channel 7 is controlled by monitoring pump operation and is not provided with a control device on pendant 25.

The intrinsically safe remote control system permits the miner remote control pendant 25 to be hand-held. It is preferred to make an intrinsically safe pendant 25 out of light-weight high-impact moisture-resistant plastic rather than metal. Plastic eliminates a multiple grounding path from the electronic system used herein, thereby minimizing electronic design and maintenance problems with the entire remote control system.

Thirteen differential proportional and step type control signals from miner pendant 25, together with one differential step type control signal from pump-monitor time delay device 202 in FIG. 7A, are fed as fourteen individual inputs to corresponding differential valve drivers 256 to 269 operative in control channels 1 to 14 as part of low voltage controls 71. Each differential valve driver 256 to 269 is circuited as shown in FIG. 10 so that it can be used interchangably with any electronic force motor 122 actuating on a FIG. 4 electro-control valve, whether or not its use is in a proportional valve bank 61 or in on/off valve bank 62. Valve driver interchangability contributes to the universality of the remote control system.

Each differential valve driver 256 to 269 is capable of producing a differential output voltage having offset and dither components as shown in FIG. 5. The output voltage varies proportional to a linear input current from pendant 25 which represents the miner hydraulic function to be controlled, regardless of whether the input current is a proportional or step type current.

Low voltage controls 71 also include dither oscillator 270 which generates a conventional differential square wave output signal on lead 187. The dither output signal is preadjusted to a fixed amplitude and frequency. Dither frequency is between 50 and 60 hz. and represents the best frequency range for minimizing frictional and contamination effects of the electro-control valve shown in FIG. 4. The dither output signal on lead 187 is connected to an input summing junction of every valve driver 256 to 269. Here the dither signal becomes a component, along with an offset component, of what is combined with the remote control current to form a total input current for each control channel 1 to 14. A typical dither signal 187 component is shown in FIG. 5 inset and is always present in valve driver output signal regardless of whether the remote control current is zero, maximum, or a proportional value therebetween.

A tram half-speed circuit 271 shown in FIG. 11 is also included in low voltage controls 71. The tram halfspeed circuit 271 monitors cutter head operation by way of the signal on lead 212. This signal is fed from latch circuit 210 output in the cutter head motor 35, 36 stop circuit shown in FIG. 7A. Right and left trams 29, 28 are normally permitted to be drive hydraulically up to full forward and reverse speeds by the remote control currents of proportional remote control devices 245, 246 being fed to two inputs of tram half-speed circuit 271. However, when cutter head motors 35, 36 become operational, tram halfspeed circuit 271 automatically reduces tram forward speed only by one-half the value of up to a full setting of remote control device 245, 246. Output from tram half-speed circuit 271 is fed to the inputs of valve drivers 259, 260 in the right and left tram remote control channels 4 and 5.

All of the valve drivers 256 to 269, the dither oscillator 270 and the tram half-speed circuit 271 comprising low voltage circuits 71 are intrinsically safe circuits fabricated preferably on plug-in circuit boards and housed in a nonexplosion-proof enclosure not shown. This construction feature facilitates maintenance of the miner remote control system both above ground and below ground in a hazardous environment.

Six outputs from differential valve drivers 256 to 261 in proportional control channels 1 to 6 are fed to corresponding force motors 272 to 277 in the main bank of proportional electro-control valves 61. Eight outputs from differential valve drivers 262 to 269 are fed to corresponding force motors 278 to 285 in the auxiliary bank of pilot on/off electro-control valves 62. Each force motor 272 to 285 is the same as force motor 122 shown schematically in FIG. 4 and provides an electro-valve pull and push control force characterized in FIG. 5 when energized by the differential output from any valve driver noted above. Operation of control channels 1 to 14 wherein force motor 272 to 285 function will be described below.

In FIGS. 9A to 9D there is shown four schematic diagrams of thirteen remote control devices 242 to 247 and 249 to 255 shown in FIGS. 8A, 8B that are incorporated in miner remote control pendant 25. FIG. 9A illustrates differential proportional remote control devices 242, 247 used in control channels 1, 6 for up-down control action. Each of these control devices consist of selfcentering, lever action, dual potentiometers 286A, 286B connected in parallel across the +6′ V, −6′ V source. Potentiometers 286A, 286B are connected for slider counter-rotation so that an output signal on leads 287, 288 will vary differentially proportional to slider position and hydraulic function to be controlled on miner 20.

When the sliders are centered there is zero output across leads 287, 288. When the sliders are directed to the up position, the signal on lead 287 is negative (−) and on lead 288 is positive (+), both varying proportional to slider positions from center. When the sliders are directed to the down position, the opposite polarity of the same magnitude signal is produced on leads 287, 288. That is, the signal on lead 287 becomes positive and that on lead 288 becomes negative proportional to slider positions from center. The differentially varying proportional output signals on leads 287, 288 in remote control devices 242, 247 are connected to the inputs of corresponding valve drivers 256, 261.

FIG. 9B illustrates differential proportional remote control devices 243,244 used in control channels 2, 3 for up-down or left-right control action, respectively. Each of these control devices includes a press-type D.P.D.T. deadman switch 289 having a normally open pair of contacts connected to the −6′ V, +6′ V source and a normally closed pair of contacts connected to ground. Also included in each of these control devices is a self-centering, lever-action, dual potentiometer 290A, 290B connected in parallel across the common poles of deadman switch 289 by way of leads 290, 291. Potentiometers 290A, 290B are connected for slider counter-rotation so that an output signal on leads 293, 294 will vary differentially proportional to slider position and hydraulic function to be controlled.

When deadman switch 289 is released or otherwise not pressed, the output on leads 293, 294 is grounded regardless of slider position. When deadman switch 289 is pressed and maintained that way and both sliders are centered, there is zero output on leads 293, 294. When the sliders are directed to the up, or left, position, the signal on lead 293 is positive (+) and on lead 294 is negative (−), both varying proportional to slider positions from center. When the sliders are directed to the down, or right, position, a signal of the opposite polarity and same magnitude is produced on leads 292, 294. That is, the signal on lead 293 becomes negative and that on lead 294 becomes positive proportional to their slider positions from center. The differentially varying proportional output signals on leads 293, 294 in remote control devices 243, 244 are connected to the inputs of corresponding valve drivers 257, 258.

FIG. 9C illustrates differential proportional remote control devices 245, 246 being used cooperatively in control channels 4, 5 for reverse-forward control action, respectively. Each of these control devices includes presstype D.P.D.T. deadman switch 295 having a normally open pair of contacts connected to +6′ V, −6′ V source and a normally closed pair of contacts connected through respective resistors 296, 297 to ground. Also included in each of these control devices is a self-centering, lever-action, dual potentiometer 298A, 298B connected in parallel across the common poles of deadman switch 295 by way of leads 299, 300. Potentiometers 298A, 298B are connected for slider counter-rotation so that an output signal on leads 301, 302 will vary differentially proportional to slider position and hydraulic function to be controlled.

When deadman switch 295 is released or otherwise not pressed, the output on leads 301, 302 is grounded through resistors 296, 297 regardless of slider position. When deadman switch 289 is pressed and maintained that way and both sliders are centered, there is zero output on leads 301, 302. When the sliders are directed to their reverse position, the signal on lead 301 is negative (−) and on lead 302 is positive (+), both varying proportional to slider positions from center. When the sliders are directed to the forward position, a signal of opposite polarity and same magnitude is produced on leads 301, 302. That is, the signal on lead 301 becomes positive and that on lead 302 becomes negative proportional to their slider positions from center.

The differentially varying output signals on leads 301, 302 in right tram remote control device 245 is connected to a right tram input of tram half-speed circuit 271 in FIG. 11. Cooperating with remote control device 245 is device 246 which has the common poles of its deadman switch 295 connected in parallel with device 245 by way of leads 299, 300. In that way, either deadman switch 295 may be pressed to start miner tram movement, but both deadman switches must be released to stop tram movement. The differentially varying output signals of left tram remote control device 246 occur on separate output leads 303, 304 which are connected to a left tram input of tram half-speed circuit 271 in FIG. 11. Right and left tram outputs from tram half-speed circuits 271 are connected to respective valve drivers 259, 260 as described below.

FIG. 9D illustrates differential step type remote control devices 249 to 255 being used in control channels 8 to 14 for on-off, up-down, or forward-reverse control action. Each of these control devices consists of a toggle type D.P.D.T. switch 305 having a normally open pair of contacts connected to the +6′ V, −6′ V source and a normally closed pair of contacts connected to the +6′ V, +6′ V source. Output leads 306, 307 are connected to the common poles of toggles switch 305 and to the inputs of corresponding valve drivers 263 to 269.

Toggle switch 305 functions as a polarity reversal switch. When switch 305 is in the off, down, or reverse position as shown, lead 306 receives a −6′ V signal and lead 307 receives a +6′ V signal. When switch 305 is in the on, up, or forward position opposite that shown, lead 306 receives a +6′ V signal and lead 307 receives a −6′ V signal. Thus, the particular step type hydraulic function to be controlled by remote control devices 249 to 255 will depend on the polarity reversing position of their corresponding toggle switches 305.

Turning now to FIG. 10, there is shown a schematic diagram of an intrinsically safe differential valve driver circuit having first and second halves of substantially the same circuitry operating at reversed polarities. FIG. 10 typifies each of the fourteen differential valve drivers 256 to 269 that are used for both proportional and step type remotely controlled hydraulic functions on miner 20. In the description of a valve driver that follows, reference will be made to only a differential proportional control signal input of up to ±6′ V from a remote control device, such as device 242, output on leads 287, 288, as opposed to a step type control signal which will become self-evident.

The purpose of such valve driver 256 to 269 is to receive a differentially variable control signal and a differential dither signal component, monitor the control signal and produce positive (+) and negative (−) offset signal components, amplify the combined control, dither and offset signals, thereby to produce a differentially variable valve driver output signal having a combined control and offset characteristic as shown in FIG. 5. It is to be noted that the dither signal 187 component shown in FIG. 5 inset is always overlaid in the valve driver output signal to minimize valve frictional and contamination effects, even when the input control signal is zero. Valve driver output is fed to B, W terminals of coil 123 in electro-valve force motor 122.

The major components of both first and second halves of each differential valve driver 256 to 269 include a pair of control signal input terminals 308, 309 which receive a differentially variable control signal from remote control device 242. A dither signal input terminal 310 is included to receive a differential dither signal from dither oscillator 270 over lead 187. In addition, solid-state differential offset amplifiers 311, 312 are included to monitor the input signals and generate the positive (+) and negative (−) offset signal components. Further, solid-state differential power operational amplifiers 313, 314 are included to combine the control, dither and offset signals, thereby producing a ±6′ V differentially variable valve driver output signal at output terminals 315, 316.

More specifically, in the first half of valve driver circuitry a control signal current from input terminal 308 passes through monitoring junction 317, control summing resistor 318, summing junction 319, and to the negative (−) input of power operational amplifier 313. The positive (+) input of amplifier 313 is grounded. The differential voltage output of power operational amplifier 313 at terminal 315 is determined by the value of feedback resistor 320 and the polarity of the control voltage at input terminal 308. When input terminal 308 is +, output terminal 315 will be +, and vice versa.

Offset amplifier 311 positive (+) input is connected to control signal monitor junction 317 by way of resistor 321 for the purpose of sensing the amplitude and polarity of the control signal at input terminal 308. Amplifier 311 negative (−) or reference input is connected between voltage dividing resistors 322 and 323, the latter being connected to a +6 V reference source.

Assuming input terminals 308+, 309− condition arises, offset amplifier 311 compares only a positive variable signal at monitoring junction 317 with the positive reference signal across resistor 322. The difference between inputs is amplified by offset amplifier 311 and output to offset junction 324 as a positive offset voltage component. The magnitude of positive offset voltage at offset junction 324 is determined by the value of feedback resistor 325 and the voltage dividing resistor 322, these being selected to produce the positive offset requirement for the electro-valve characterized in FIG. 5.

The offset voltage component at junction 324 is fed through offset resistor 326 to summing junction 319 where it is combined with the differentially variable control voltage produced by control current flowing through control summing resistor 318. Thus, the positive offset voltage component at summing junction 319 modifies the input to power operational amplifier 313, and therefore its output at output terminal 315, inversely proportional to the difference between inputs of offset amplifier 311 as will be explained below.

Also combined at summing junction 319 is the differential dither signal component input at terminal 310 which is fed through dither summing resistor 327 to summing junction 319. The differential dither signal component is added to the control and offset signals, thereby modifying the output of power operational amplifier 313 and the differential output signal at output terminal 315. The combining of control, offset and dither signals is permitted to occur at summing junction 319 up to the saturation point of solid-state power operational amplifier 313. It is to be noted that the dither signal component is always present in the differential output signal at terminal 315, regardless of whether the control input signal varies between zero and ±6′ V.

The second half of the differential valve driver circuitry and operation thereof is the same as the first half circuitry, except the polarity is reversed and there is no dither signal to combine with the control and offset signals. A control signal current from input terminal 309 passes through monitoring junction 328, control summing resistor 329, summing junction 330, and to the negative (−) input of power operational amplifier 314. The positive (+) input to amplifier 314 is grounded. The differential voltage output of power operational amplifier 314 at terminal 316 is determined by the value of feedback resistor 331 and the polarity of the control voltage at input terminal 309. When input terminal 309 is negative (−), output terminal 316 will be negative (−) and vice versa.

Offset amplifier 312 positive (+) is connected to control signal monitor junction 328 by way of resistor 332 for the purpose of sensing the amplitude and polarity of the control signal at input terminal 309. Amplifier 312 negative (−) or reference input is connected between voltage dividing resistors 333 and 334, the latter being connected to a +6 reference source. Assuming as above input terminals 309−, 308+, offset amplifier 312 has no output because it only compares positive input signals.

However, when input terminal 309+, 308− condition arises, offset amplifier 312 compares the positive variable signal at monitoring junction 328 with the positive reference signal across resistor 333. The difference between inputs is amplified by offset amplifier 312 and output to offset junction 335 as a positive offset voltage component. The magnitude of positive offset voltage at offset junction 335 is determined by the value of feedback resistor 336 and the voltage dividing resistor 333, these being selected to produce the negative offset requirement for the electrovalve characterized in FIG. 5 by curve 186.

The offset voltage component at junction 335 is fed through offset resistor 337 to summing junction 330 where it is combined with the differentially variable control voltage produced by control current flowing through control summing resistor 329. Thus, a positive offset voltage component at summing junction 330 modifies the input to power operational amplifier 314, and therefore its output at output terminal 316, inversely proportional to the difference between inputs of offset amplifier 312 as will be explained as follows.

Operation of both first and second halves of differential valve drivers 256 to 269 will now be described. Assuming the potentiometer 286A, 286B sliders are centered and remote control device 240 has zero output on output leads 287, 288. A zero voltage appears at control signal input terminals 308, 309, and at respective monitoring junctions 317, 328. This produces minimum positive difference signals across respective inputs of offset amplifiers 311, 312. This produces equal positive offset signal components at summing junctions 319, 330, and therefore equal positive driver output signals at output terminals 315, 316. Consequently, the B, W terminals have equal positive signals bucking each other in force motor coil 123, thereby causing force motor armature 124 to assume a centered position. Hence, in FIG. 4 the pilot spool 149 in pilot stage 104 and power spool 167 in power stage 105 assume a centered or neutral position.

When potentiometer 286A, 286B sliders move very slightly toward the down position, a finite positive and negative signal is produced at output leads 287,288, respectively, proportional to slider shaft movement. This establishes a finite positive and negative input control signals at input terminals 308, 309, respectively, as well as at first and second half monitoring junctions 317, 328, respectively. Inasmuch as offset amplifiers 311, 312 only amplify positive differences at their differential inputs, only offset amplifier 311 produces the positive offset signal component at summing junction 319 in response to the finite positive input at monitoring junction 317. Offset amplifier 312 input becomes zero because of a finite negative input control signal at monitoring junction 328.

The net effect of this at valve driver output terminals 315, 316 is a finite positive control signal combined with the positive offset signal at terminal 315 and finite negative control signal at terminal 316. This causes a B+, W− signal condition at force motor coil 123 which immediately moves armature 124 upward proportional to the offset signal and the positive finite input signal. In FIG. 4, pilot stage piston 135 immediately pulls on power spool 167 to overcome its offset at cylinder 1 port and allows a proportionally finite power fluid outflow from cylinder 1 port to begin immediately.

As potentiometer 286A, 286B sliders are moved to the full down position, an increasingly larger positive and negative input control signal appears at monitoring junctions 317, 328, respectively, as well as summing junctions 319, 330, respectively. By suitable choice of voltage divider resistors 322, 323 and feedback resistor 325 in what will be referred to as the positive offset amplifier 311, the positive offset signal component at summing junction 319 will vary inversely proportional to the input control signal at terminal 308.

The inverse relationship continues until the monitored and reference inputs of positive offset amplifier 311 are equal, at which point amplifier 311 saturates and produces its maximum positive offset signal at summing junction 319. The positive input control voltage monitored at junction 317 continues to increase beyond the saturation point of amplifier 311 until the combined control, offset and dither signals at summing junction 319 cause power operational amplifier 313 to saturate with a positive output voltage at output terminal 315.

As the negative control signal input at terminal 309 increases, so does the control signal at summing junction 330. There is no negative offset signal component at summing junction 330 because of the difference in polarity of monitoring and reference signals at the inputs of what will be referred to as the negative offset amplifier 312. Nevertheless, the negatively variable control signal at summing junction 330 will cause power operational amplifier 314 to produce a negative output signal at output terminal 316 proportional to the negative control signal input at terminal 309.

As a valve driver developes a differentially varying output signal at output terminals 315+, 316−, the B+, W− signal in force motor coil 123 varies proportionally to cause pilot stage piston 135 and power spool 167 to vary cylinder 1 port outflow proportional thereto.

When potentiometer 286A, 286B sliders are moved oppositely from their centered position toward the up position, the polarity of their output signals reverse at output leads 287, 288, as does the polarity of the respective control signal at input terminals 308, 309 and first and second half monitoring junctions 317, 328. At first, a finite negative and positive control signal is produced at input terminals 308, 309, then a larger magnitude control signal, both proportional to potentiometer 286A, 286B slider shaft position. Both halves of the valve driver circuitry now operate opposite to that described above.

The positive offset amplifier 311 does not produce an offset signal component at summing junction 319 because the control input terminal 308 is negative, thus causing the monitoring input of amplifier 311 to be negative with respect to its positive reference signal input. Therefore the power operational amplifier 313 output will now be negative at output terminal 315 instead of positive as above.

The negative offset amplifier 312 does produce the negative offset signal that varies inversely proportional at summing junction 330 because the control input terminal 309 is positive, thus causing the monitoring input of amplifier 312 to be positive with respect to its positive reference signal input. Although the offset signal produced by offset amplifier 312 was initiated by a positive monitored signal at input terminal 309, its effect on power operational amplifier 314, and therefore on force motor coil 123, is the opposite of the positive offset signal component from amplifier 311. The output from offset amplifier 312 fed to summing junction 330 will be referred to as the negative offset signal component and this corresponds to the negative offset portion of curve 186 in FIG. 5.

The combined positive-polarity control and offset signals at summing junction 330 are amplified by power operational amplifier 314 and output at valve driver output terminal 316 as a positive signal. This causes a B−, W+ signal relationship in force motor coil 123 that causes armature 124 to move downward or opposite to that described above. This effectively causes pilot spool 149 in FIG. 4 to move downward, pilot piston 135 and power spool 167 pushed on to immediately overcome power spool 167 offset with respect to cylinder port 2. Power fluid outflow from cylinder 2 port is proportional to the 308−, 309+ input control signal.

In summarizing the FIG. 10 differential valve driver operation, it has been shown that a differential proportional input signal at control signal input terminals 308, 309 will produce a corresponding differential proportional output signal at output terminals 315, 316. Further, that a dither signal component and an offset signal component are combined with the variable control signal to produce the differential output signal. Moreover, that either a positive or a negative offset signal component is produced, one at a time, by monitoring a positive control signal at one of the control signal inputs 308, 309 when the other input is negative. The offset signal components correspond to the deadband of an electro-control valve such as is shown in FIG. 4.

To complete the description of low voltage controls 71, of which the above-described valve drivers 256 to 269 are a major part, reference will now be made to FIG. 11 schematic diagram of tram half-speed circuit 271. This circuit 271 is connected between right and left tram proportional remote control devices 245, 246 and differential valve drivers 259, 260 in control channels 4, 5. Purpose of tram half-speed circuit 271 is to electronically monitor cutter head drive motor 35, 36 operation and automatically reduce to one-half the proportional forward speed, but not reverse speed, of hydraulic-driven right and left trams 29, 28 established by proportional remote control devices 245, 246. When cutter heads are not operating, both trams are permitted to operate up to full forward or reverse proportional speed under channel 4, 5 remote control, unless overridden by control channel 13 step type remote control of tram half-speed hydraulically as described below.

Tram half-speed circuit 271 has two modes of operation, namely, half-speed and full-speed modes. These are determined by solid-state logic control gates 338, 339 operating in respective right and left tram speed control circuits, in unison, in response to a high or low monitoring signal received over lead 212 from the cutter head stop relay K6 in FIG. 7A. A high monitoring signal on head 212 indicates the cutter head stop relay K6 is energized and the cutter heads are not operating. A low monitoring signal on lead 212 indicates the cutter heads are not stopped but are operating.

Control gates 338, 339 each include solid-state comparator, logic circuits, and relay circuits K9, K10, respectively, which operate similtaneously in response to the monitoring signal on lead 212. Control gate 338 comparator operates against a +6 V reference source and control gate 339 comparator operates against a +6 V reference source.

A high monitoring signal at control gates 338, 339, indicating stopped cutter heads, closes normally open relay contacts K9, K10 and bypasses corresponding right and left tram half-speed adjusting networks 340, 341. This establishes a full-speed operating mode and connects the right and left tram remote control signals on leads 301, 302 and 303, 304 directly to respective output leads 342, 302 and 343, 304 in networks 340, 341. In this manner, the full right and left tram remote control signals are applied directly to valve driver 259, 260 inputs.

Each half-speed adjusting network 340, 341 consists of a resistor 344, 345 serially connected with a respective rheostat 346, 347, and inserted serially between respective input leads 301, 303 and output leads 342, 343. Rheostats 346, 347 provide for individual half-speed tram to overcome differences in right and left tram 29, 28 traction mechanisms.

A low monitoring signal at control gates 338, 339, indicating operating cutter heads, open relay contacts K9, K10 and directs right and left remote control signals from devices 245, 246 through half-speed adjusting networks 340, 341. This establishes the half-speed operating mode and reduces by about 50% the right and left tram output signals on leads 342, 302 and 343, 304 which feed the inputs to corresponding valve drivers 259, 260. Thus, it can be seen that changing of the monitoring signal from high to low, indicating a change in cutter head operation from stopped to operating, automatically changes control of right and left tram forward speed from full-speed to half-speed operating mode of tram half-speed circuit 271. Inasmuch as the half-speed adjusting networks 340, 341 are only in the forward speed output leads 301, 303, they do not affect the reduction of reverse tram speed control signal from remote control devices 245, 246.

OPERATION OF MINER REMOTE CONTROL SYSTEM

Operation of the intrinsically safe remote control system for continuous mining machine 20 will now be described with reference to TABLE 1 and the drawings, particularly FIGS. 1, 2, 3, 7A, 7B, 8A, 8B. It is assumed that remote/manual switch 66 on miner 20 is in the remote position, thereby permitting operator 24 to remotely control miner 20 from hand-held miner remote control pendant 25 trailing miner 20. Further, that master power-on switch 197 on pendant 25 is turned on to energize the intrinsically safe remote control system with +6′ V and −6′ V.

The control functions that follow are initiated by operator 24 from individual remote control devices on miner remote control pendant 25. Hydraulic pumps and electrically driven cutter heads must be started in sequence before other remote control functions may be performed. First, pump switch 198 must be closed momentarily to the on position which starts dual hydraulic pump drive motor 57 instantly, and after a time delay automatically starts variable volume hydraulic pump motor 59.

Drive motor 57 is coupled to dual constant volume hydraulic pumps 58 which include isolated pilot oil system 89 and power oil system 92. Isolated pilot oil system 89 is connected to only pilot stages 104 in main bulk of proportional electro-control valves 61 used in control channels 1 to 6 described below. Power oil system 92 is connected to auxiliary bank of pilot on/off electro-control valves 62 used in control channesl 7 to 14 and to other hydraulic loads on miner 20. Drive motor 59 is coupled to variable volume hydraulic pump and system 60 which is connected to power stages 105 of main valve bank 61, the latter powering the miner proportionally controlled hydraulic loads in control channels 1 to 6. Thus, all hydraulic power and control systems are now operating.

Second in sequence starting, cutter head switch 199 is closed momentarily to the on position which starts left cutter head drive motor 35 instantly, and after a time delay automatically starts right cutter drive motor 36. In practice, cutter head drive motors 35, 36 drive left and right cutter heads 33, 34. These cutter head drive motors are interlocked with the variable volume hydraulic pump drive motor 59 and may acutally be started at any time after pump motor 59 is operating.

Pump and cutter head switches 198, 199 both have a momentary off position which may be used to stop respective pump drive motors 57, 59 and cutter head drive motors 35, 36 in reverse starting sequence. In addition, emergency stop switch may be pushed momentarily to stop all pump and cutter drive motors 57, 59, 35, 36, simultaneously.

Operation of control channels 1 to 6 involving the main bank of proportional electro-control valves 61 may occur any time after pressures in the hydraulic systems have built up to their respective operating levels. Reference to deadman remote control devices below mean that their control action is contingent upon operator 24 first pressing the deadman switch incorporated into the control device. Whenever the deadman switch is released, the control function ceases. A description of proportional control channels 1 to 6 follows.

Control channel 1 is devoted to controlling the elevation of cutter boom 30 anywhere between up and down limits 32, 31 by means of remote control device 242, valve driver 256 and force motor 272 acting on cutter boom valve 98. When control device 242 is centered and produces a zero output signal, valve 98 is neutral and holds cutter boom 30 midway between up and down positions 32, 31. Up control produces a proportional B−, W+ signal on force motor 272 which acts on valve 98 to cause cutter boom 30 to elevate as far as upper limit 32. Down control produces a proportional B+, W− signal on force motor 272 which acts oppositely to the up signal and causes cutter boom 30 to lower as far as down limit 31.

Control channel 2 is devoted to controlling conveyor 47 lift anywhere between up and down limits 49, 48 by means of remote control device 243, valve driver 257 and force motor 273 acting on conveyor lift valve 99. When deadman remote control device 243 is centered and produces a zero output signal, valve 99 is neutral and holds conveyor 47 midway between its up and down positions 49, 48. Up control produces a proportional B+, W− signal on force motor 273 which acts on valve 99 to conveyor 47 to lift as far as its upper limit 49. Down control produces a proportional B−, W+ signal on force motor 273 which acts oppositely to the up signal.

Control channel 3 is devoted to controlling conveyor 47 tail swing horizontally from center position 50 to anywhere between left and right limits 51, 52 by means of deadman remote control device 244, valve driver 258, and force motor 274 acting on conveyor tail swing valve 100. When deadman remote control device 244 is centered and produces a zero output signal, valve 100 is neutral and holds conveyor 47 tail swing at center position 50. Left control produces a proportional B+, W− signal on force motor 274 which acts on valve 100 to cause conveyor 47 tail to swing horizontally from center position 50 leftward anywhere within left limit 51. Right control produces a B+, W− signal on force motor 274 which acts oppositely to the left signal and causes conveyor 47 tail to swing horizontally from center position 50 rightward anywhere within right limit 52.

Control channels 4 and 5 are devoted to controlling right and left tram 29, 28 speed, forward and reverse direction, and forward half-speed with cutter heads 33, 34 operating. Both control channels 3 and 4 operate in unison to remove coal from seam 21, but independently, or in opposition to each other to steer the fore/aft/turning direction of miner 20. Control channels 4 and 5 are controlled by means of deadman right and left tram remote control devices 245, 246, tram half-speed circuit 271, valve drivers 259, 260 and force motors 275, 276 acting on right and left tram valves 101, 102.

When deadman remote control devices 245, 246 in control channels 4 and 5 each is centered and produces a zero output signal, valves 101, 102 are both in a neutral position and maintain right and left trams 20, 28 at a stand still. Forward control produces a proportional B−, W+ signal on force motors 259, 260 which act on valves 101, 102 to cause trams 29, 28 to move miner 20 forward at a full speed proportional to control position. When cutter head motors 35, 36 are operating, tram half-speed circuit 271 is activated and automatically limits forward tram 29, 28 speed to about 50% proportional forward speed. Reverse control produces a B+, W− signal on force motors 275, 276 which act on valves 275, 276 oppositely to the forward signal, that is, to cause trams 29, 28 to move miner 20 at a full reverse speed proportional to control position. There is no tram halfspeed control in either tram reverse speed control. It should be noted that miner 20 may be steered right or left, forward or reverse, or turned about a vertical axis by moving controls on remote control devices 245, 246 differentially or oppositely with respect to each other.

Control channel 6 is devoted to controlling the elevation of gathering pan 44 anywhere between up and down limits 46, 45 by means of remote control device 247, valve driver 261 and force motor 277 acting on gathering pan valve 103. When control device 247 is centered and produces a zero output signal, valve 103 is neutral and holds gathering pan 44 midway between up and down limits 46, 45. Up control produces a proportional B−, W+ signal on force motor 277 which acts on valve 103 to cause gathering pan 44 to elevate as far as upper limit 49. Down control produces a proportional B+, W− signal on force motor 277 which acts oppositely to the up signal and causes gathering pan 44 to lower as far as down limit 48.

Operation of control channels 7 to 14 involving the auxiliary bank of pilot on/off electro-control valves 62 may also occur any time after pressures in the hydraulic systems have built up to their respective operating levels. A description of on/off control channels 7 to 14 follows:

Control channel 7 is devoted to automatic dump control remotely of variable volume hydraulic pump system 60 by means of time delay device 202 in the pump start circuit rather than a control device on pendant 25, the valve driver 262 connected to device 202, and a force motor 278 acting on variable volume pump dump control valve 110. When variable volume pump system 60 has been started by pump switch 198 and is operating, time delay device 202 does not become activated but produces a B−, W+ step type signal on force motor 278 which acts on valve 110 to permit normal operation of pump system 60. However, a preset time delay after pump system 60 is deenergized, time delay device 202 becomes activated and produces a B+, W− step type signal on force motor 278 which acts on valve 110 to actuate a dump control hydraulic circuit for pump system 60, thereby relieving pump system 60 pressure so that on the next start sequence drive motor 59 may start without pump load and allow variable volume hydraulic pump system 60 to build up pressure gradually. This minimizes starting load fluctuations in high voltage source 55.

Control channel 8 is devoted to turning on and off a hydraulic mechanism for oscillating left and right cutter head arms 37, 38 continuously between left and right arm inward positions 39, 40 and their outward positions 41, 42, independently of cutter boom elevation control by channel 1. This control is effected by remote control device 249, valve driver 263 and force motor 279 acting on cutter head oscillator valve 111. Off control produces a step type B−, W+ signal on force motor 279 which acts on valve 111 to incapacitate the hydraulic cutter oscillator mechanism. On control produces a step type B+, W− signal on force motor which acts on valve 111 to turn on the hydraulic cutter oscillator mechanism.

Control channel 9 is devoted to raising hand lowering hydraulic stabilizing jack 53 on miner 20 by means of remote control device 250, valve driver 264 and force motor 280 acting on stabilizing jack valve 112. Up and down control produces a step type B+, W− and B−, W+ signal on force motor 280 which acts on valve 112 to raise and lower hydraulic stabilizing jack 53 to respective up and down positions.

Control channel 10 is devoted to turning on and off main water sprays, fed by miner water hose 54, by means of remote control device 251, valve driver 265 and force motor 281 acting on water deluge valve 113. On and off control produces respective B+, W− and B−, W+ step type control signals on force motor 28i which acts on valve 113 to turn the main water spray on and off, respectively.

Control channel 11 is devoted to turning on and off water deluge, fed by miner water hose 54, by means of remote control device 252, valve driver 266 and force motor 282 acting on water deluge valve 114. On and off control produces respective B+, W− and B−, W+ step type control signals on force motor 282 which acts on valve 114 to turn the water deluge on and off, respectively.

Control channel 12 is devoted to turning on and off conveyor 47 hydraulic drive motor by means of remote control device 253, valve driver 267 and force motor 283 acting on conveyor run valve 115. On and off control produces respective B+, W− and B+, W+ step type control signals on force motor 283 which acts on valve 115 to turn conveyor 47 on and off, respectively.

Control channel 13 is devoted to hydraulic switching from high to low speeds of right and left tram 29, 28 hydraulic drive motors by means of remote control device 254, valve driver 268 and force motor 284 acting on tram half-speed valve 116. This control channel operates independently of proportional control channels 4 and 5. High and low speed control produces B+, W− and B+, W+ step type control signals on force motor 284 which acts on valve 116 to change tram speed from high to low speed, respectively.

Control channel 14 is devoted to hydraulic switching from forward to reverse direction of conveyor 47 by means of remote control device 255, valve driver 269 and force motor 285 acting on conveyor direction valve 117. Forward and reverse direction control produces B+, W− and B+, W+ step type control signals on force motor 285 which acts on valve 117 to change conveyor 47 direction of operation from forward to reverse, respectively.

In the foregoing description, the quantity and type of proportional and on/off electro-control valves in each valve banks 61, 62 may be well suited for retrofitting a continuous mining machine such as represented by miner 20. However, it will now be apparent that at least some, if not all, of the step type control functions described above may be controlled with proportional type electro-control valves in new installations where valve and piping space constraints are not as severe as in older mining machines.

Finally, manual mode of operating the miner remote control system will be described. Remote/manual switch 66 is turned to manual position and it is assumed that cutter head and pump switches 199, 198 were turned off in sequence. Low voltage power supply 68 is deenergized, consequently all remote control devices on pendant 25, all valve drivers and the like in low voltage controls 71, and all force motors in valve banks 61, 62, are all incapacitated because they too are deenergized. Under this condition, constant volume-pump motor 57 and variable volume pump motor 59 may be stopped and started locally by respective manual stop and start pushbuttons 214-1, 214-3 and 214-2 and 214-4 in sequence. After that, left and right cutter head drive motors 35, 36 may be stopped and started sequentially as above by local manual stop and start pushbuttons 214-5 and 214-6, respectively. When hydraulic pressures build up, hydraulic functions in control channels 1 to 6 may be controlled individually by manual overrides 106 in valve bank 61. Hydraulic functions in control channels 7 to 14 may be controlled individually by manual overrides 118 in valve bank 62. A return to remote mode of operation of miner 20 may be made at any time.

Based on the foregoing description of a preferred embodiment of this invention, it will be apparent from the description of the miner hydraulic system that although electro-control valves 98 to 103 in the main bank of proportional electro-control 61 which are used for proportional control of hydraulic loads herein, may also be used elsewhere to control on/off hydraulic loads. Likewise, electro-control valves 110 to 117 in the auxiliary bank of pilot on/off valves 62 which are used for on/off control of loads herein, may also be used elsewhere for proportional load control. In addition, it will also be apparent from the description of the miner electrical system that differential proportional valve drivers 256 to 269 each contain first and second circuit halves herein each half containing an offset amplifier may be used elsewhere alone for a proportional valve load not having a differential operating requirement.

We claim:

1. A mining machine remote control system for controlling one or more fluid-powered machine operating functions, said system comprising:

(a) electro-control valve means for controlling the machine operating functions in response to operating function control signals, at least one valve in said means having proportional flow and deadband characteristics, (b) pendant means producing a separate operator-initiated remote control signal for each said machine operating function, at least one of these remote control signals having valve-related proportional characteristics, and (c) controller means receiving the separate remote control signals for producing the separate operating function control signals, at least one of these operating function control signals having the valve-related proportional flow characteristic modified by an offset signal component for overcoming valve deadband characteristics.

2. The system according to claim 1 wherein the pendant means and the controller means incorporate intrinsically safe circuits.

3. The system according to claim 1 wherein the controller means includes a dither oscillator and produces at least one offset-modified proportional operating function control signal further modified by a dither signal component for minimizing additional valve frictional characteristics.

4. The system according to claim 1 wherein the pendant means and controller means each have differential type proportional remote control signals and corresponding proportional operating function control signals.

5. The system according to claim 1 wherein the pendant means produces a differential type proportional remote control signal, and the controller means includes means for monitoring the differential proportional remote control signal and produces the offset signal component.

6. The system according to claim 1 wherein the pendant means produces a differential type proportional remote control signal, and the controller means includes differential valve driver means for monitoring and amplifying the differential proportional remote control signal, and in response thereto selectively applying either a positive or negative type offset signal component modification to the differential proportional operating function control signals.

7. The system according to claim 1 wherein the pendant means includes a deadman switch incorporated in at least one remote control signal producing device to insure human operator participation in remote control of said mining machine.

8. The system according to claim 1 wherein there is incorporated means operatively associated with the pendant means and controller means for providing remote and manual operating modes of the remote control system.

9. The system according to claim 1 wherein there is incorporated test switch means operatively associated with solid-state control devices in the controller means.

10. The system according to claim 1 wherein the pendant means includes individual remote control devices for pump operation, material cutting, gathering, conveying and spraying, and machine tram propelling, steering and positioning, and jacking.

11. The system according to claim 1 wherein the pendant means and the controller means includes means for starting at least one hydraulic pump, and if desired other loads, automatically in sequence responsive to one of the remote control signals.

12. The system according to claim 1 wherein the controller means includes circuit means for automatically reducing remote control means tram speed a predetermined amount in response to monitoring the operation of another machine operating function.

13. The system according to claim 1 wherein the controller means includes circuit means for automatically reducing remote control means tram speed signal a predetermined amount, and limited to one direction of tram travel, in response to monitoring the operation of another machine operation function.

14. The system according to claim 1 wherein the electro-control valve means includes one or more electrically operated valves with a hydraulic servo controlled valve stage having a mechanical feedback element for nulling the proportional valve operation.

15. A mining machine system for remotely controlling one or more fluid-powered machine operating functions, said system comprising:

(a) a pressurized fluid source, (b) electro-control valve means including a hydraulic servo-controlled pilot stage valve for each machining operation function which receives a separate operating function control signal, each pilot stage valve connected to the fluid source and to a load having proportional flow and/or valve deadband characteristics, and (c) remote control means initiated by an operator for the separate operating function control signals, at least one of said signals having valve-related proportional flow characteristics and/or modified by an offset signal component for overcoming the valve deadband characteristic.

16. A mining machine system for remotely controlling one or more fluid-powered machine operating functions, said system comprising:

(a) a pressurized power fluid source susceptible to contamination, (b) a pressurized control fluid source isolated from the power fluid source, (c) electro-control valve means including a hydraulic servo-controlled pilot stage valve for each machine operating function which receives a separate operating function control signal, each pilot stage valve connected hydraulically to the control fluid source and coupled mechanically to a corresponding power stage valve which is connected hydraulically to the power fluid source, at least one power stage valve having proportional flow and deadband characteristics, and (d) remote control means initiated by an operator for producing the operating function control signals, at least one of said signals having valve-related proportional flow characteristics modified by an offset signal component for overcoming the valve deadband characteristics.

17. The system according to claims 15 or 16 wherein the mining machine operating functions include pump operation, material cutting, gathering, conveying and spraying and machine tram propelling, steering and positioning, and jacking.

18. The system according to claims 15 or 16 wherein a pressurized source includes a motorized variable volume pump having a dump control activated by a valve in the electro-control valve means.

19. The system according to claims 15 or 16 wherein electro-control valve means with pilot stage hydraulic servo includes a mechanical feedback element for nulling proportional valve operation.

20. The system according to claims 15 or 16 wherein electro-control valve means with pilot stage hydraulic servo comprises an electrical force motor acting on a pilot stage pool in cooperation with a mechanical feedback sleeve and pilot stage piston.

21. The system according to claims 15 or 16 wherein electro-control valve means indicates a manual override mechanism.

22. The system according to claims 15 or 16 wherein the means for producing operating function control signals includes intrinsically safe circuits.

23. The system according to claims 15 or 16 wherein the remote control means comprises:

(1) pendant means producing a separate operator-initiated proportional remote control signal for each said machine operating function, and (2) controller means receiving the separate remote control signals for producing separate proportional operating function control signals.

24. The system according to claims 15 or 16 wherein the remote control means produces differential type proportional control signals.

25. The system according to claims 15 or 16 wherein the remote control means produces the proportional control signals modified by a dither signal component for minimizing valve frictional characteristics.

26. The system according to claims 15 or 16 wherein the remote control means includes circuit means for reducing machine tram speed a predetermined amount in response to monitoring another machine operating function.

27. The system according to claims 15 or 16 wherein the remote control means includes circuit means for reducing machine tram speed a predetermined amount, and limited to one direction of tram travel, in response to monitoring another machine operating function.

* * * * *

UNITED STATES PATENT AND TRADEMARK OFFICE

CERTIFICATE OF CORRECTION

PATENT NO. : 4,192,551

DATED : March 11, 1980

INVENTOR(S) : James C. Weimer et al.

It is certified that error appears in the above-identified patent and that said Letters Patent are hereby corrected as shown below:

Col. 12, line 24, "effor" should read --effort--.

Col. 13, line 50, "led" should read --lead--.

Col. 21, line 40, "+ 6'V," should read -- -6' V-- (minus sign instead of a plus sign).

Col. 26, line 31, "+ 6" should read -- -6--. (minus sign instead of a plus sign).

Col. 27, line 29, "bulk" should read --bank--.

Col. 27, line 32, "channesl" should read --channel--.

Col. 27, line 47, "acutally" should read --actually--.

Col. 28, line 22, the word "cause" should be inserted before the word "conveyor".

Col. 28, line 38, "B+" should read --B-(minus sign)-- and "W-" should read --W+--.

Col. 28, line 57, "20" should read --29--.

Col. 29, line 63, "hand" should read --and--.

Col. 30, line 23, "B+" 2nd occurrence, should read -- B-(minus) --.

Col. 30, line 33, "B+" should read --B-(minus)--.

Col. 30, line 41, "B+" 2nd occurrence, should read -- B-(minus) --

UNITED STATES PATENT AND TRADEMARK OFFICE

CERTIFICATE OF CORRECTION

PATENT NO. : 4,192,551

DATED : March 11, 1980

INVENTOR(S) : James C. Weimer et al.

It is certified that error appears in the above—identified patent and that said Letters Patent is hereby corrected as shown below:

Column 31, line 25, "herein" should read -- wherein --.

Column 32, line 43, "operation" should read -- operating --.

Column 34, line 2, "pool" should read -- spool --.

Column 34, line 5, "indicates" should read -- includes --.

Signed and Sealed this

*Twenty-fourth* Day of *June 1980*

[SEAL]

*Attest:*

SIDNEY A. DIAMOND

*Attesting Officer*

*Commissioner of Patents and Trademarks*